US011672348B2

(12) United States Patent
Bucholz et al.

(10) Patent No.: US 11,672,348 B2
(45) Date of Patent: Jun. 13, 2023

(54) FURNITURE MEMBER HAVING LUMBAR ADJUSTMENT MECHANISM

(71) Applicant: La-Z-Boy Incorporated, Monroe, MI (US)

(72) Inventors: Brandon Bucholz, Chattanooga, TN (US); Alexander M. Hegedus, Chattanooga, TN (US); Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 17/739,624

(22) Filed: May 9, 2022

(65) Prior Publication Data

US 2022/0257021 A1 Aug. 18, 2022

Related U.S. Application Data

(63) Continuation-in-part of application No. 17/313,272, filed on May 6, 2021, now Pat. No. 11,324,324, (Continued)

(51) Int. Cl.
*A47C 7/48* (2006.01)
*A47C 7/46* (2006.01)

(52) U.S. Cl.
CPC ..... *A47C 7/462* (2013.01)

(58) Field of Classification Search
CPC ..... B60N 2/6671; B60N 2/6673; B60N 2/66; B60N 2/666; A47C 7/46; A47C 1/03255; (Continued)

(56) References Cited

U.S. PATENT DOCUMENTS 3,588,170 A 6/1971 Knabusch et al.
3,890,000 A 6/1975 Easley
(Continued)

FOREIGN PATENT DOCUMENTS

CN 201438906 U 4/2010
DE 3600790 A1 7/1987
(Continued)

OTHER PUBLICATIONS

International Search Report for Application No. PCT/US2011/047371, dated Apr. 9, 2012.
(Continued)

*Primary Examiner* — Shin H Kim
(74) *Attorney, Agent, or Firm* — Harness, Dickey & Pierce, P.L.C.

(57) ABSTRACT

A furniture assembly may include a seat bottom, a seatback, and a lumbar adjustment assembly. The seatback is disposed adjacent the seat bottom and includes a seatback frame. The lumbar adjustment assembly may be mounted to the seatback frame and may include a rail, a threaded rod disposed within the rail, a first slider block slidably engaging the rail, a second slider block slidably engaging the rail, a lumbar pad, and links connecting the lumbar pad to the first and second slider blocks. The threaded rod may include a first threaded section having threads with a first handedness and a second threaded section having threads with a second handedness that is opposite the first handedness. The first slider block may threadably engage the first threaded section. The second slider block may threadably engage the second threaded section. One or more massaging units may be mounted to the lumbar pad.

30 Claims, 22 Drawing Sheets

Related U.S. Application Data which is a continuation-in-part of application No. 17/208,197, filed on Mar. 22, 2021, now Pat. No. 11,284,724, which is a continuation of application No. 16/672,878, filed on Nov. 4, 2019, now Pat. No. 10,952,535.

(60) Provisional application No. 62/755,849, filed on Nov. 5, 2018.

(58) Field of Classification Search
CPC ..... A47C 7/462; A47C 1/023; A47C 1/03238; A47C 1/03274
See application file for complete search history.

(56) References Cited

U.S. PATENT DOCUMENTS

| | | | |
|---|---|---|---|
| 4,072,287 | A | 2/1978 | Swenson et al. |
| 4,148,522 | A | 4/1979 | Sakurada et al. |
| 4,182,533 | A | 1/1980 | Arndt et al. |
| 4,295,681 | A | 10/1981 | Gregory |
| 4,296,965 | A | 10/1981 | Sakurada et al. |
| 4,354,709 | A | 10/1982 | Schuster |
| 4,469,374 | A | 9/1984 | Kashihara et al. |
| 4,678,230 | A | 7/1987 | Winkle |
| 4,725,095 | A | 2/1988 | Benson et al. |
| 4,968,093 | A | 11/1990 | Dal Monte |
| 4,981,325 | A | 1/1991 | Zacharkow |
| 5,007,677 | A | 4/1991 | Ozawa et al. |
| 5,087,098 | A | 2/1992 | Ishizuka |
| 5,088,790 | A | 2/1992 | Wainwright et al. |
| 5,217,278 | A | 6/1993 | Harrison et al. |
| 5,240,308 | A | 8/1993 | Goldstein et al. |
| 5,299,851 | A | 4/1994 | Lin |
| 5,462,335 | A | 10/1995 | Seyler |
| 5,474,358 | A | 12/1995 | Maeyaert |
| 5,482,350 | A | 1/1996 | Komorowski et al. |
| 5,507,559 | A | 4/1996 | Lance |
| 5,553,919 | A | 9/1996 | Dennis |
| 5,651,580 | A | 7/1997 | LaPointe et al. |
| 5,730,494 | A | 3/1998 | LaPointe et al. |
| 5,871,258 | A | 2/1999 | Battey et al. |
| 5,927,144 | A | 7/1999 | Koch |
| 5,979,984 | A | 11/1999 | DeKraker et al. |
| 5,984,407 | A | 11/1999 | Ligon, Sr. et al. |
| 6,086,153 | A | 7/2000 | Heidmann et al. |
| 6,116,695 | A | 9/2000 | Heidmann et al. |
| 6,179,384 | B1 | 1/2001 | DeKraker et al. |
| 6,254,186 | B1 | 7/2001 | Falzon |
| 6,257,664 | B1 | 7/2001 | Chew et al. |
| 6,357,826 | B1 | 3/2002 | Gabas et al. |
| 6,367,877 | B1 | 4/2002 | Knoblock et al. |
| 6,394,545 | B2 | 5/2002 | Knoblock et al. |
| 6,394,548 | B1 | 5/2002 | Battey et al. |
| 6,394,549 | B1 | 5/2002 | DeKraker et al. |
| 6,402,246 | B1 | 6/2002 | Mundell |
| 6,520,580 | B1 | 2/2003 | Hong |
| 6,572,190 | B2 | 6/2003 | Koepke et al. |
| 6,575,530 | B1 | 6/2003 | Fischer et al. |
| 6,609,755 | B2 | 8/2003 | Koepke et al. |
| 6,616,228 | B2 | 9/2003 | Heidmann |
| 6,631,951 | B2 | 10/2003 | Blendea et al. |
| 6,676,214 | B2 | 1/2004 | McMillen et al. |
| 6,695,402 | B2 | 2/2004 | Sloan, Jr. |
| 6,729,691 | B2 | 5/2004 | Koepke et al. |
| 6,880,886 | B2 | 4/2005 | Bodnar et al. |
| 6,908,153 | B2 | 6/2005 | Blendea |
| 6,932,430 | B2 | 8/2005 | Bedford et al. |
| 6,938,955 | B2 | 9/2005 | VanSickle |
| 7,007,568 | B2 | 3/2006 | MacAulay et al. |
| 7,014,269 | B2 | 3/2006 | Coffield et al. |
| 7,044,551 | B2 | 5/2006 | Fujita et al. |
| 7,066,537 | B2 | 6/2006 | Coffield et al. |
| 7,131,694 | B1 | 11/2006 | Buffa |
| 7,140,681 | B2 | 11/2006 | McMillen |
| 7,165,811 | B2 | 1/2007 | Bodnar et al. |
| 7,204,556 | B2 | 4/2007 | Schwerdtner et al. |
| 7,226,130 | B2 | 6/2007 | Tubergen et al. |
| 7,264,311 | B2 | 9/2007 | Heidmann |
| 7,448,684 | B2 | 11/2008 | Hsiao |
| 7,770,972 | B2 | 8/2010 | Popa |
| 8,091,966 | B2 | 1/2012 | Schweizer et al. |
| 8,091,967 | B2 | 1/2012 | Schweizer et al. |
| 8,474,909 | B2 | 7/2013 | LaPointe et al. |
| 8,506,009 | B2 | 8/2013 | LaPointe et al. |
| 8,807,651 | B2 | 8/2014 | LaPointe et al. |
| 9,604,559 | B2 | 3/2017 | Yoo |
| 9,732,832 | B2 | 8/2017 | Kristen |
| 9,744,891 | B2 | 8/2017 | Cho et al. |
| 10,066,717 | B2 | 9/2018 | Kristen |
| 10,952,535 | B2 | 3/2021 | Bucholz et al. |
| 2002/0113472 | A1 | 8/2002 | Blendea et al. |
| 2002/0195854 | A1 | 12/2002 | Hong |
| 2003/0006636 | A1 | 1/2003 | Ligon et al. |
| 2003/0184139 | A1 | 10/2003 | Sloan, Jr. |
| 2004/0104609 | A1 | 6/2004 | Blendea |
| 2004/0108760 | A1 | 6/2004 | McMillen |
| 2004/0160099 | A1 | 8/2004 | Hong |
| 2005/0046251 | A1 | 3/2005 | Foelster et al. |
| 2006/0244293 | A1 | 11/2006 | Buffa |
| 2007/0108816 | A1 | 5/2007 | McQueen et al. |
| 2008/0164738 | A1 | 7/2008 | Colja et al. |
| 2008/0217978 | A1 | 9/2008 | Stossel et al. |
| 2009/0079245 | A1 | 3/2009 | Marcantoni |
| 2010/0033002 | A1 | 2/2010 | Di Giusto et al. |
| 2011/0115268 | A1 | 5/2011 | Maierhofer et al. |
| 2011/0127817 | A1 | 6/2011 | Yu et al. |
| 2012/0068508 | A1 | 3/2012 | LaPointe et al. |
| 2013/0341982 | A1 | 12/2013 | Maierhofer et al. |
| 2014/0070583 | A1 | 3/2014 | McMillen et al. |
| 2014/0070584 | A1 | 3/2014 | McMillen et al. |
| 2014/0125101 | A1 | 5/2014 | Hong |
| 2014/0125102 | A1 | 5/2014 | McMillen et al. |
| 2014/0125103 | A1 | 5/2014 | Suzuki |
| 2015/0305506 | A1 | 10/2015 | Suzuki et al. |
| 2016/0250957 | A1 | 9/2016 | Yoo |
| 2016/0288682 | A1 | 10/2016 | Oho et al. |
| 2021/0251388 | A1 | 8/2021 | Bucholz et al. |

FOREIGN PATENT DOCUMENTS

| | | | |
|---|---|---|---|
| EP | 0458440 | A1 | 11/1991 |
| JP | S6137212 | A | 2/1986 |
| JP | S6137213 | A | 2/1986 |
| JP | H01143958 | U | 10/1989 |
| JP | H05207920 | A | 8/1993 |
| JP | H0819452 | A | 1/1996 |
| JP | 2003159149 | A | 6/2003 |
| JP | 2014094598 | A | 5/2014 |
| KR | 20030075271 | A | 9/2003 |
| KR | 101149075 | B1 | 5/2012 |
| KR | 101388983 | B1 | 4/2014 |
| KR | 20140048743 | A | 4/2014 |
| KR | 101491313 | B1 | 2/2015 |
| WO | WO-2008006200 | A1 | 1/2008 |
| WO | WO-2008-070991 | A1 | 6/2008 |

OTHER PUBLICATIONS

Written Opinion of the International Searching Authority for Application No. PCT/US2011/047371, dated Apr. 9, 2012.

Supplementary European Search Report for Application No. 11827153.5, dated Jan. 21, 2014.

International Search Report for Application No. PCT/US2019/059803, dated Apr. 7, 2020.

Written Opinion of the International Searching Authority for Application No. PCT/US2019/059803, dated Apr. 7, 2020.

International Search Report and Written Opinion received in corresponding Application No. PCT/US2022/026563 dated Aug. 10, 2022.

FURNITURE MEMBER HAVING LUMBAR ADJUSTMENT MECHANISM

CROSS-REFERENCE TO RELATED APPLICATIONS

This application is a continuation-in-part of U.S. patent application Ser. No. 17/313,272 filed on May 6, 2021, which is a continuation-in-part of U.S. patent application Ser. No. 17/208,197 filed on Mar. 22, 2021, which is a continuation of U.S. patent application Ser. No. 16/672,878 filed on Nov. 4, 2019, which claims the benefit of U.S. Provisional Application No. 62/755,849 filed on Nov. 5, 2018. The entire disclosures of each of the above applications are incorporated herein by reference.

FIELD

The present disclosure relates to an adjustment mechanism, such as a lumbar adjustment mechanism for a seating or furniture assembly.

BACKGROUND

This section provides background information related to the present disclosure and is not necessarily prior art.

A furniture member (e.g., a chair, sofa, loveseat, etc.) may include an adjustable lumbar support that allows a user to adjust the amount of support that a seatback of the furniture member provides at a lumbar portion of the user's back. The present disclosure provides a lumbar adjustment assembly that is compact in size while still providing a sufficiently large range of motion. The lumbar adjustment assembly of the present disclosure fits within a slimmer space within a seatback frame, which allows for a wider variety of aesthetic designs of the seatback without sacrificing functionality. In some configurations, the lumbar adjustment assembly of the present disclosure provides appropriate support in a wider width seat, such as in an oversized armchair (or "chair and a half"), for example. In some configurations, the lumbar adjustment assemblies of the present disclosure may include one or more massaging units.

SUMMARY

This section provides a general summary of the disclosure, and is not a comprehensive disclosure of its full scope or all of its features.

The present disclosure provides an assembly (e.g., a seating or furniture assembly) that may include a seat bottom, a seatback, and a lumbar adjustment assembly. The seatback is disposed adjacent the seat bottom and includes a seatback frame. The lumbar adjustment assembly may be mounted to the seatback frame and may include a rail, a threaded rod disposed within the rail, a first slider block slidably engaging the rail, a second slider block slidably engaging the rail, one or more lumbar pads, and a plurality of links connecting the lumbar pad to the first and second slider blocks. The threaded rod may include a first threaded section having threads with a first handedness and a second threaded section having threads with a second handedness that is opposite the first handedness. The first slider block may threadably engage the first threaded section. The second slider block may threadably engage the second threaded section.

In some configurations of the assembly of the above paragraph, the assembly includes a motor assembly attached to the rail and rotatably driving the threaded rod relative to the rail.

In some configurations of the assembly of either of the above paragraphs, the links include a pair of first links and a pair of second links.

In some configurations of the assembly of any or more of the above paragraphs, a first end of each of the first links is rotatably coupled to the first slider block, a second end of each of the first links is rotatably coupled to the lumbar pad, a first end of each of the second links is rotatably coupled to the second slider block, and a second end of each of the second links is rotatably coupled to the lumbar pad.

In some configurations of the assembly of any or more of the above paragraphs, the second ends of the first links and the second ends of the second links are rotatably coupled to the lumbar pad at a common rotational axis.

In some configurations of the assembly of any or more of the above paragraphs, the lumbar pad moves in a direction perpendicular to a direction in which the first and second slider blocks move along the rail.

In some configurations of the assembly of any or more of the above paragraphs, the lumbar pad moves away from the rail when the first and second slider blocks move toward each other along the rail, and the lumbar pad moves toward from the rail when the first and second slider blocks move away from each other along the rail. In other configurations of the assembly, the first and second links could be configured such that the lumbar pad moves away from the rail when the first and second slider blocks move away from each other along the rail, and the lumbar pad moves toward from the rail when the first and second slider blocks move toward each other along the rail.

In some configurations of the assembly of any or more of the above paragraphs, the seatback frame includes a lower cross member, an upper cross member, a first lateral support member, and a second lateral support member. A motor assembly of the lumbar adjustment assembly may be attached to the first lateral support member and the rail is attached to the second lateral support member.

In some configurations of the assembly of any or more of the above paragraphs, each of the first and second slider blocks includes a channel that slidably and non-rotatably receives the rail.

In some configurations of the assembly of any or more of the above paragraphs, the threaded rod is a single, unitary body.

In some configurations, the assembly of any or more of the above paragraphs includes a massaging unit mounted to the lumbar pad.

The present disclosure also provides an assembly (e.g., a seating or furniture assembly) that may include a frame, a motor assembly, a rail, a threaded rod, a first slider block, a second slider block, and a plurality of links. The motor assembly may include a housing attached to the frame. The rail may include a first end attached to the motor assembly and a second end attached to the frame. The threaded rod may be coupled to the motor assembly and may be disposed within a channel of the rail. The threaded rod may include a first threaded section having threads with a first handedness and a second threaded section having threads with a second handedness that is opposite the first handedness. The first slider block may slidably engage the rail and may threadably engage the first threaded section. The second slider block may slidably engage the rail and may threadably engage the second threaded section. The plurality of links may be rotatably coupled to the first and second slider blocks.

In some configurations of the assembly of the above paragraph, the assembly may include a support member attached to the plurality of links.

In some configurations of the assembly of either of the above paragraphs, the support member is a lumbar pad, and the frame is a seatback frame.

In some configurations of the assembly of any one or more of the above paragraphs, the seatback frame includes a lower cross member, an upper cross member, a first lateral support member, and a second lateral support member. The housing of the motor assembly may be attached to the first lateral support member and the second end of the rail may be attached to the second lateral support member.

In some configurations of the assembly of any one or more of the above paragraphs, the links include a pair of first links and a pair of second links.

In some configurations of the assembly of any one or more of the above paragraphs, a first end of each of the first links is rotatably coupled to the first slider block, a second end of each of the first links is rotatably coupled to the support member, a first end of each of the second links is rotatably coupled to the second slider block, and a second end of each of the second links is rotatably coupled to the support member.

In some configurations of the assembly of any one or more of the above paragraphs, the second ends of the first links and the second ends of the second links are rotatably coupled to the support member at a common rotational axis.

In some configurations of the assembly of any one or more of the above paragraphs, the support member moves in a direction perpendicular to a direction in which the first and second slider blocks move along the rail.

In some configurations of the assembly of any one or more of the above paragraphs, the support member moves away from the rail when the first and second slider blocks move toward each other along the rail, and the support member moves toward from the rail when the first and second slider blocks move away from each other along the rail. In other configurations of the assembly, the first and second links could be configured such that the support member moves away from the rail when the first and second slider blocks move away from each other along the rail, and the support member moves toward from the rail when the first and second slider blocks move toward each other along the rail.

In some configurations of the assembly of any one or more of the above paragraphs, each of the first and second slider blocks includes a channel that slidably and non-rotatably receives the rail.

In some configurations of the assembly of any one or more of the above paragraphs, the threaded rod is a single, unitary body.

In some configurations, the assembly of any or more of the above paragraphs includes a massaging unit mounted to the lumbar pad.

The present disclosure also provides an assembly (e.g., a seating or furniture assembly) that may include a seat bottom, a seatback, and an adjustment assembly. The seatback is disposed adjacent the seat bottom and includes a seatback frame. The lumbar adjustment assembly may be mounted to the seatback frame and may include a rail, a threaded rod disposed within the rail, first slider block slidably engaging the rail, a second slider block slidably engaging the rail, a third slider block slidably engaging the rail, one or more lumbar pads, and a plurality of links connecting the lumbar pad to the first, second, and third slider blocks. The threaded rod may include a first threaded section having threads with a first handedness and a second threaded section having threads with a second handedness that is opposite the first handedness. The first and second slider blocks may threadably engage the first threaded section. The third slider block may threadably engage the second threaded section.

In some configurations of the assembly of the above paragraph, the assembly includes a motor assembly attached to the rail and rotatably driving the threaded rod relative to the rail.

In some configurations of the assembly of either of the above paragraphs, the links include a pair of first links, a pair of second links, and a pair of third links.

In some configurations of the assembly of any or more of the above paragraphs, a first end of each of the first links is rotatably coupled to the first slider block, a second end of each of the first links is rotatably coupled to the lumbar pad, a first end of each of the second links is rotatably coupled to the second slider block, a second end of each of the second links is rotatably coupled to the lumbar pad, a first end of each of the third links is rotatably coupled to the third slider block, and a second end of each of the third links is rotatably coupled to the lumbar pad.

In some configurations of the assembly of any or more of the above paragraphs, the second ends of the first links, the second ends of the second links, and the second ends of the third links are rotatably coupled to the lumbar pad at first, second, and third rotational axes, respectively. The first, second, and third rotational axes may be spaced apart from each other and parallel to each other.

In some configurations of the assembly of any or more of the above paragraphs, the lumbar pad moves in a direction perpendicular to directions in which the first, second, and third slider blocks move along the rail.

In some configurations of the assembly of any or more of the above paragraphs, the lumbar pad moves away from the rail when the first and second slider blocks move toward the third slider block along the rail, and the lumbar pad moves toward from the rail when the first and second slider blocks move away from the third slider block along the rail.

In some configurations of the assembly of any or more of the above paragraphs, the seatback frame includes a lower cross member, an upper cross member, a first lateral support member, and a second lateral support member. A motor assembly of the adjustment assembly may be attached to the first lateral support member and the rail is attached to the second lateral support member.

In some configurations of the assembly of any or more of the above paragraphs, each of the first, second, and third slider blocks includes a channel that slidably and non-rotatably receives the rail.

In some configurations of the assembly of any or more of the above paragraphs, the threaded rod is a single, unitary body.

In some configurations, the assembly of any or more of the above paragraphs includes a massaging unit mounted to the lumbar pad.

The present disclosure also provides an assembly (e.g., a seating or furniture assembly) that may include a frame, a motor assembly, a rail, a threaded rod, a first slider block, a second slider block, a third slider block, and a plurality of links. The motor assembly may include a housing attached to the frame. The rail may include a first end attached to the motor assembly and a second end attached to the frame. The threaded rod may be coupled to the motor assembly and may be disposed within a channel of the rail. The threaded rod may include a first threaded section having threads with a first handedness and a second threaded section having threads with a second handedness that is opposite the first handedness. The first slider block may slidably engage the rail and may threadably engage the first threaded section. The second slider block may slidably engage the rail and may threadably engage the first threaded section. The third slider block may slidably engage the rail and may threadably engage the second threaded section. The plurality of links may be rotatably coupled to the first, second, and third slider blocks.

In some configurations of the assembly of the above paragraph, the assembly includes a support member attached to the plurality of links.

In some configurations of the assembly of either of the above paragraphs, the support member is a lumbar pad, and the frame is a seatback frame.

In some configurations of the assembly of any one or more of the above paragraphs, the seatback frame includes a lower cross member, an upper cross member, a first lateral support member, and a second lateral support member. The housing of the motor assembly may be attached to the first lateral support member and the second end of the rail may be attached to the second lateral support member.

In some configurations of the assembly of any one or more of the above paragraphs, the links include a pair of first links, a pair of second links, and a pair of third links.

In some configurations of the assembly of any one or more of the above paragraphs, a first end of each of the first links is rotatably coupled to the first slider block, a second end of each of the first links is rotatably coupled to the support member, a first end of each of the second links is rotatably coupled to the second slider block, a second end of each of the second links is rotatably coupled to the support member, a first end of each of the third links is rotatably coupled to the third slider block, and a second end of each of the third links is rotatably coupled to the support member.

In some configurations of the assembly of any one or more of the above paragraphs, the second ends of the first, second, and third links are rotatably coupled to the support member at first, second, and third rotational axes, respectively. The first, second, and third rotational axes may be spaced apart from each other and parallel to each other.

In some configurations of the assembly of any one or more of the above paragraphs, the support member moves in a direction perpendicular to directions in which the first, second, and third slider blocks move along the rail.

In some configurations of the assembly of any one or more of the above paragraphs, the support member moves away from the rail when the first and second slider blocks move toward the third slider block along the rail, and the support member moves toward from the rail when the first and second slider blocks move away from the third slider block along the rail.

In some configurations of the assembly of any one or more of the above paragraphs, each of the first, second, and third slider blocks includes a channel that slidably and non-rotatably receives the rail.

In some configurations of the assembly of any one or more of the above paragraphs, the threaded rod is a single, unitary body.

In some configurations, the assembly of any or more of the above paragraphs includes a massaging unit mounted to the lumbar pad.

The present disclosure also provides a furniture assembly that includes a seat bottom, a seatback, a lumbar adjustment assembly, and a massaging unit. The seatback is disposed adjacent the seat bottom and including a seatback frame. The lumbar adjustment assembly may be mounted to the seatback frame and may include a lumbar pad, a plurality of links connecting the lumbar pad, and a motor assembly configured to drive the links to move the lumbar pad relative to the seatback frame between a first position and a second position. The lumbar pad is configured to push an upholstery of the seatback as the lumbar pad moves between the first and second positions. The massaging unit mounted to the lumbar pad and configured to move with the lumbar pad relative to the seatback frame between the first position and the second position.

In some configurations of the furniture assembly of the above paragraph, the massaging unit is configured to transmit vibration through the lumbar pad.

In some configurations of the furniture assembly of either of the above paragraphs, the massaging unit is mounted within a cavity formed in the lumbar pad.

In some configurations, the furniture assembly of any one or more of the above paragraphs includes a damping pad in contact with the lumbar pad and the massaging unit.

In some configurations of the furniture assembly of any one or more of the above paragraphs, the massaging unit includes a motor, an output shaft, and a rotationally unbalanced weight. The output shaft is connected to the rotationally unbalanced weight, and the motor spins the output shaft and the rotationally unbalanced weight relative to the lumbar pad.

In some configurations of the furniture assembly of any one or more of the above paragraphs, the lumbar pad includes a wire-routing aperture through which a wire connected to the massaging unit extends.

In some configurations of the furniture assembly of any one or more of the above paragraphs, the lumbar pad includes a resiliently flexible arm that secures the massaging unit to the lumbar pad.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
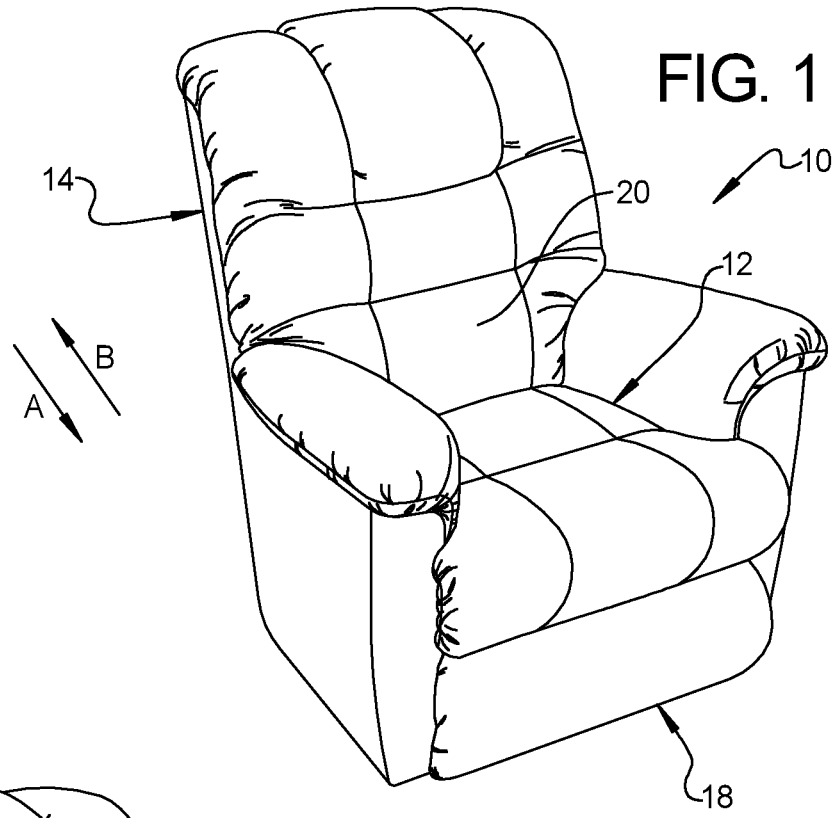
FIG. 1 is a perspective view of a furniture member with a legrest mechanism in a retracted position.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
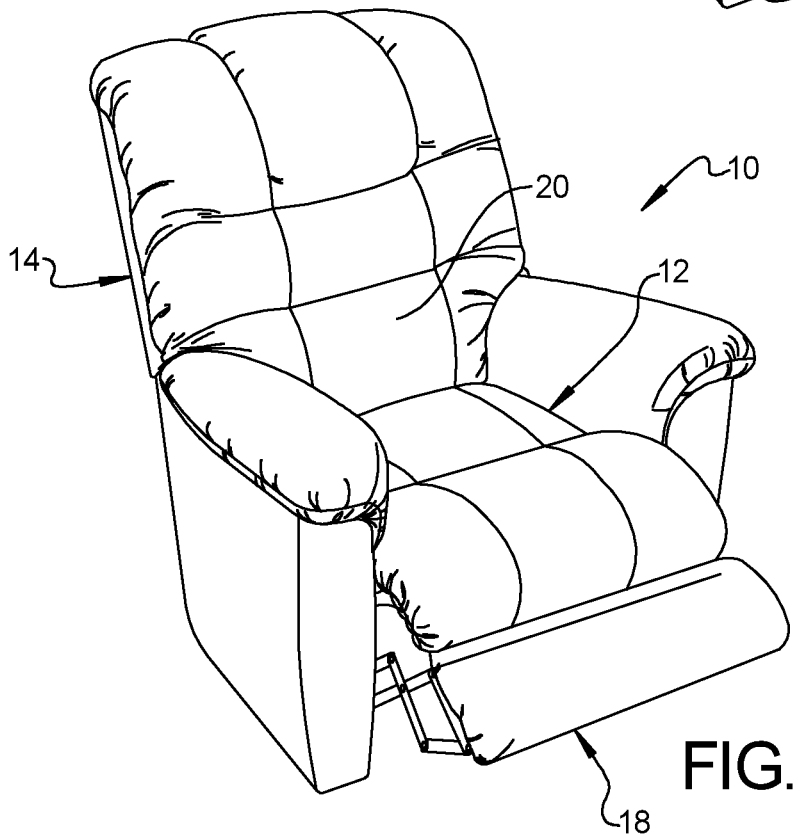
FIG. 2 is a perspective view of the furniture member with the legrest mechanism in an extended position.

With reference to FIGS. 1-11, a seating or furniture assembly 10 (FIGS. 1 and 2) is provided that may include a seat bottom 12, a seatback 14, and a lumbar adjustment mechanism or assembly 16 (FIGS. 3-11). In some configurations, the seatback 14 may be movable relative to the seat bottom 12 between reclined and upright positions. In some configurations, the seating or furniture assembly 10 may include a legrest assembly 18 that is movable relative to the seat bottom 12 between a retracted position (FIG. 1) and an extended position (FIG. 2). The seatback 14 includes a lumbar support section 20 in which the lumbar adjustment assembly 16 is disposed. As will be described in more detail below, the lumbar adjustment assembly 16 can be actuated to move the lumbar support section 20 of the seatback 14 in a lumbar extension direction A to increase occupant lumbar support or in a lumbar retraction direction B to decrease occupant lumbar support. The lumbar adjustment assembly 16 is operable independently of any seatback reclining mechanism, tilting mechanism or the legrest assembly 18.

Figure 3:
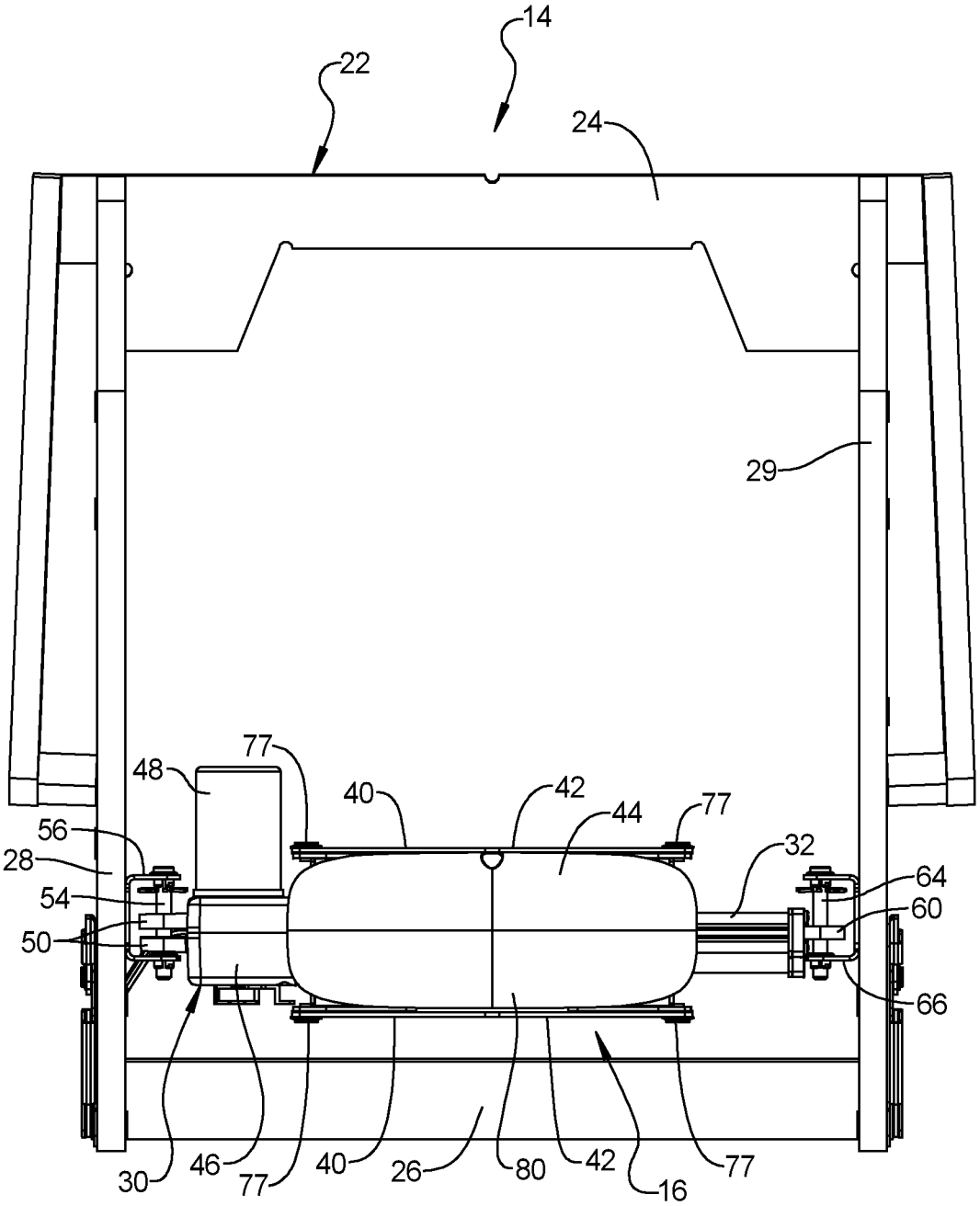
FIG. 3 is a front view of a seatback of the furniture member with upholstery and padding removed to show a lumbar adjustment assembly.
Figure 4:
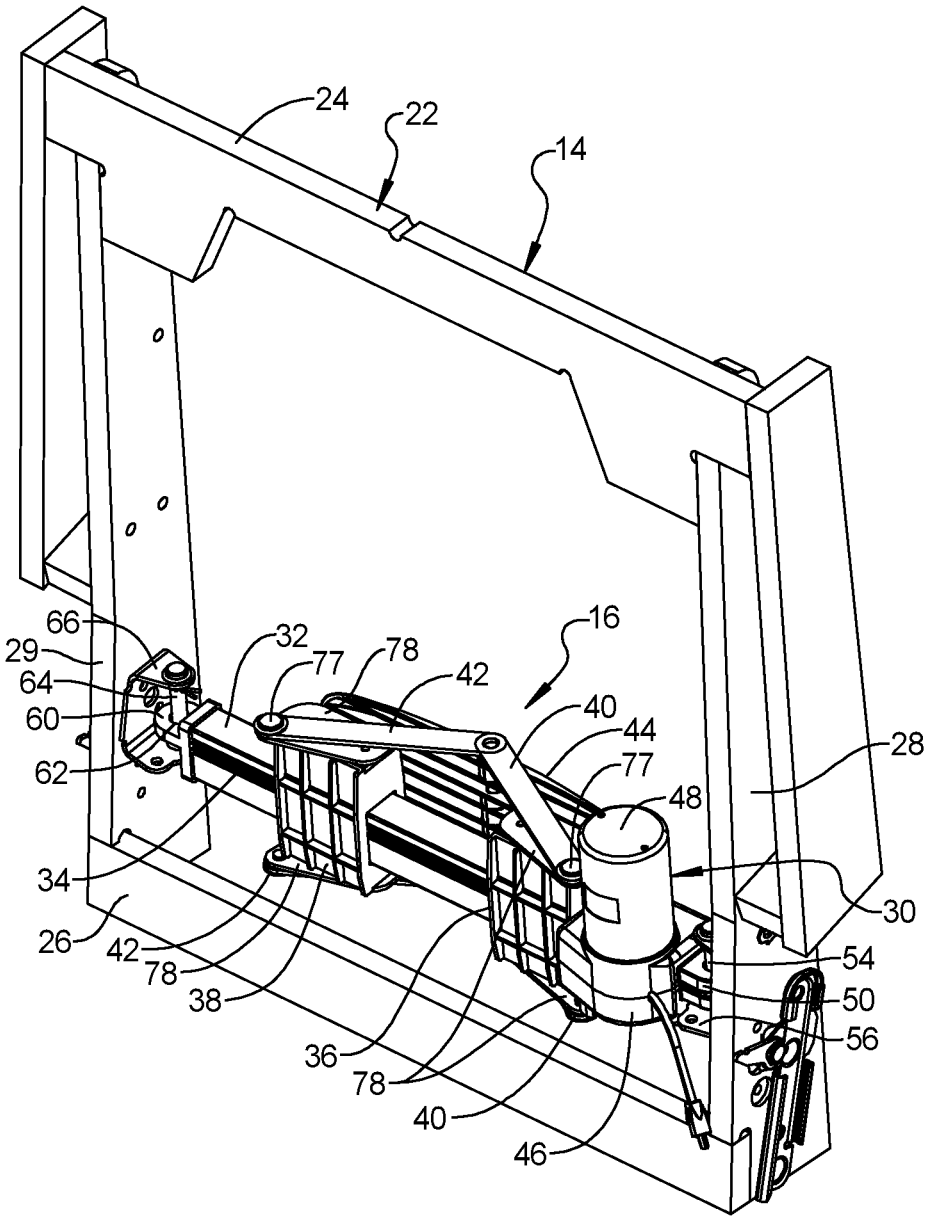
FIG. 4 is a perspective view of the seatback and lumbar adjustment assembly.

Referring now to FIGS. 3 and 4, the seatback 14 includes a seatback frame 22 (which, in FIGS. 1 and 2, is shown covered with padding and upholstery) that may have an upper cross member 24, a lower cross member 26 (i.e., the end adjacent the seat bottom 12 when the seating or furniture assembly 10 is fully assembled), and first and second lateral support members 28, 29 extending between the upper and lower cross members 24, 26. The lumbar adjustment assembly 16 may be mounted to the first and second lateral support members 28, 29. The lumbar adjustment assembly 16 may be disposed between the upper and lower cross members 24, 26 at a location corresponding to the lumbar support section 20 (FIGS. 1 and 2) of the seatback 14.

As shown in FIGS. 3-11, the lumbar adjustment assembly 16 may include a motor assembly 30, a rail 32, a threaded rod 34, a first slider block 36, a second slider block 38, a pair of first links 40, a pair of second links 42, and a lumbar pad or support member 44. The motor assembly 30 may include a housing 46 and a motor 48. The housing 46 may include one or more mounting projections 50 each having an aperture 52. A connecting pin 54 may extend through the aperture(s) 52 and engage a mounting bracket 56 that is fixedly attached to the first lateral support member 28. It will be appreciated that the motor assembly 30 could be mounted to the seatback 14 in any suitable manner.

Figure 5:
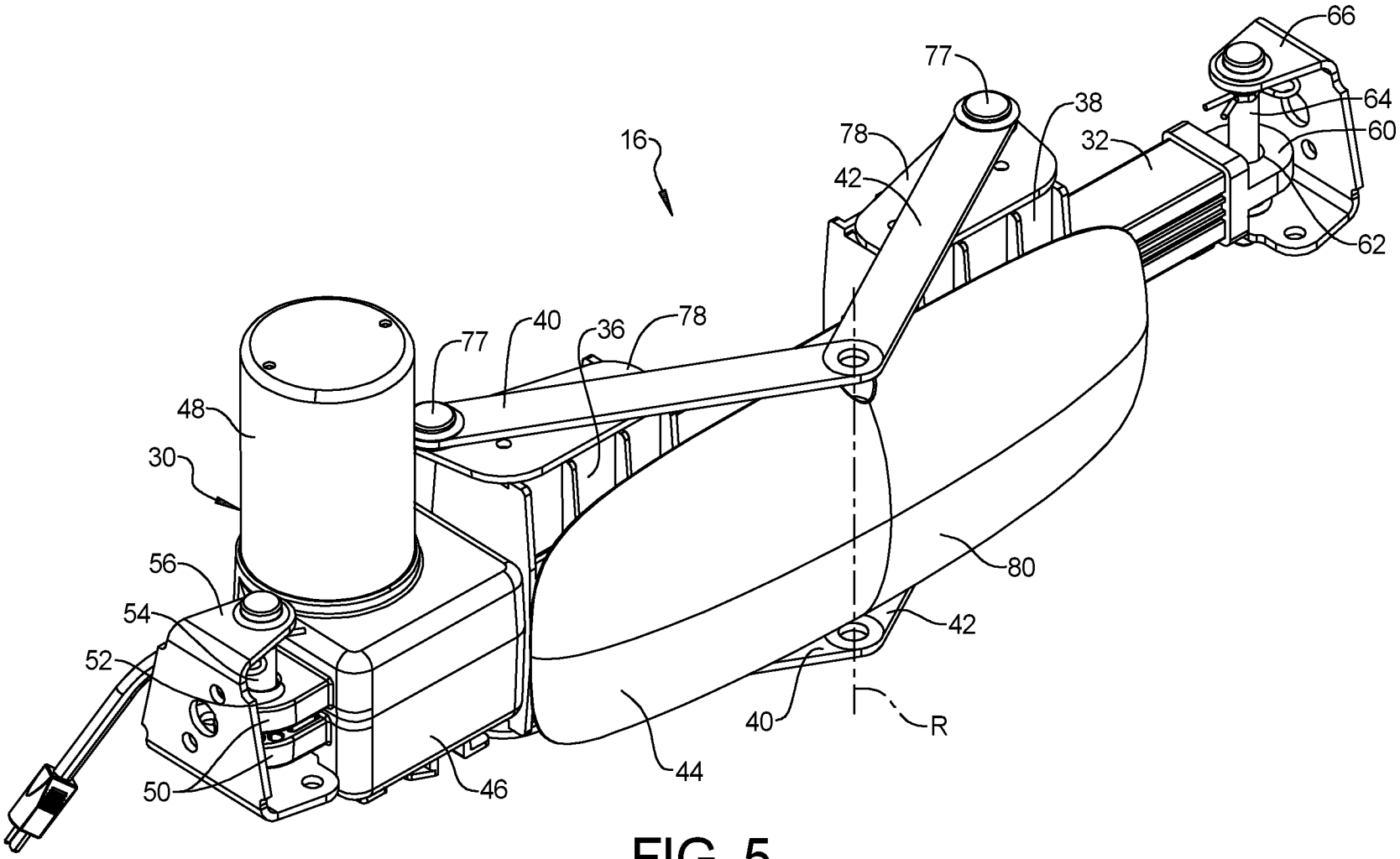
FIG. 5 is a perspective view of the lumbar adjustment assembly in a retracted position.
Figure 6:
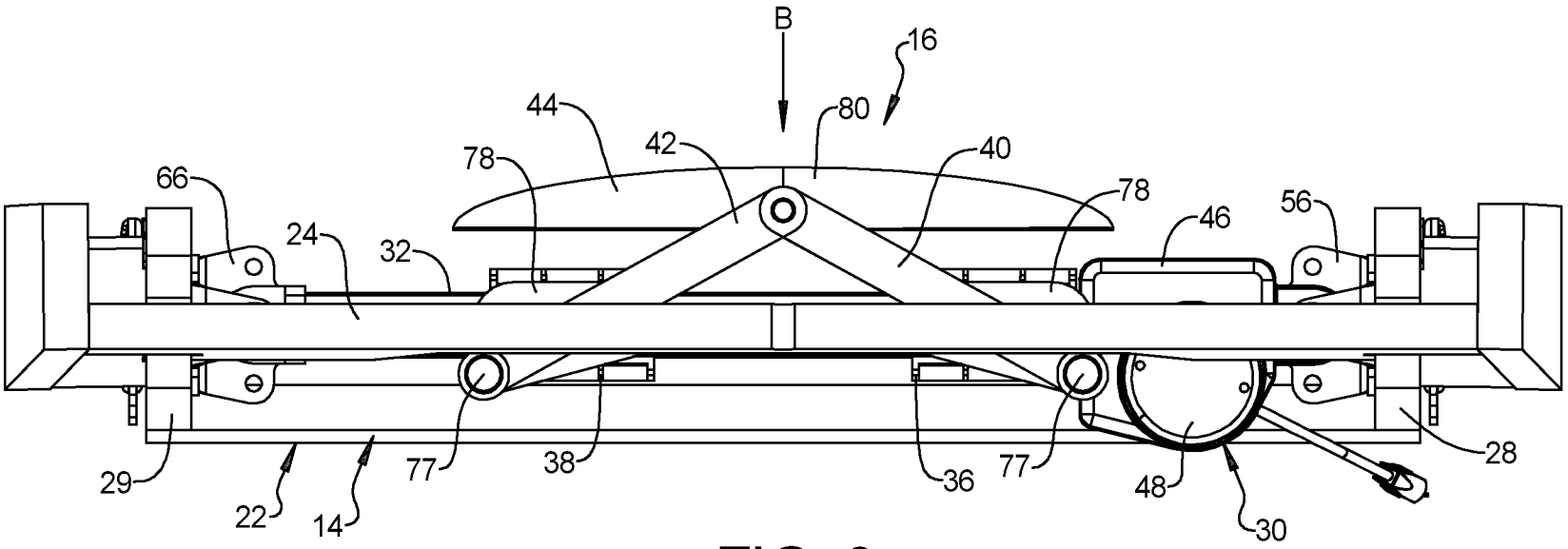
FIG. 6 is a top view of the seatback and lumbar adjustment assembly in the retracted position.

The motor 48 may be attached to and/or disposed at least partially within the housing 46. The motor 48 may be operatively coupled (e.g., via one or more output shafts disposed in the motor housing 46 and, in some configurations, via gears and/or other couplings) to the threaded rod 34 such that operation of the motor 48 causes rotation of the threaded rod 34 about a longitudinal axis of the threaded rod 34. As will be described in more detail below, operation of the motor 48 in a first direction causes the lumbar pad 44 to move relative to the seatback 14 in the lumbar extension direction A toward an extended position (FIGS. 7 and 8), and operation of the motor 48 in a second direction causes the lumbar pad 44 to move relative to the seatback 14 in the lumbar retraction direction B toward a retracted position (FIGS. 5 and 6).

The rail 32 may be an elongated member that defines an internal cavity 58 (FIGS. 10 and 11) in which the threaded rod 34 is disposed. One end of the rail 32 may be fixedly attached to the housing 46 and another end of the rail 32 may include a mounting projection 60. The mounting projection 60 may include an aperture 62 that receives a connecting pin 64 that engages a mounting bracket 66 that is fixedly attached to the second lateral support member 29.

Figure 9:
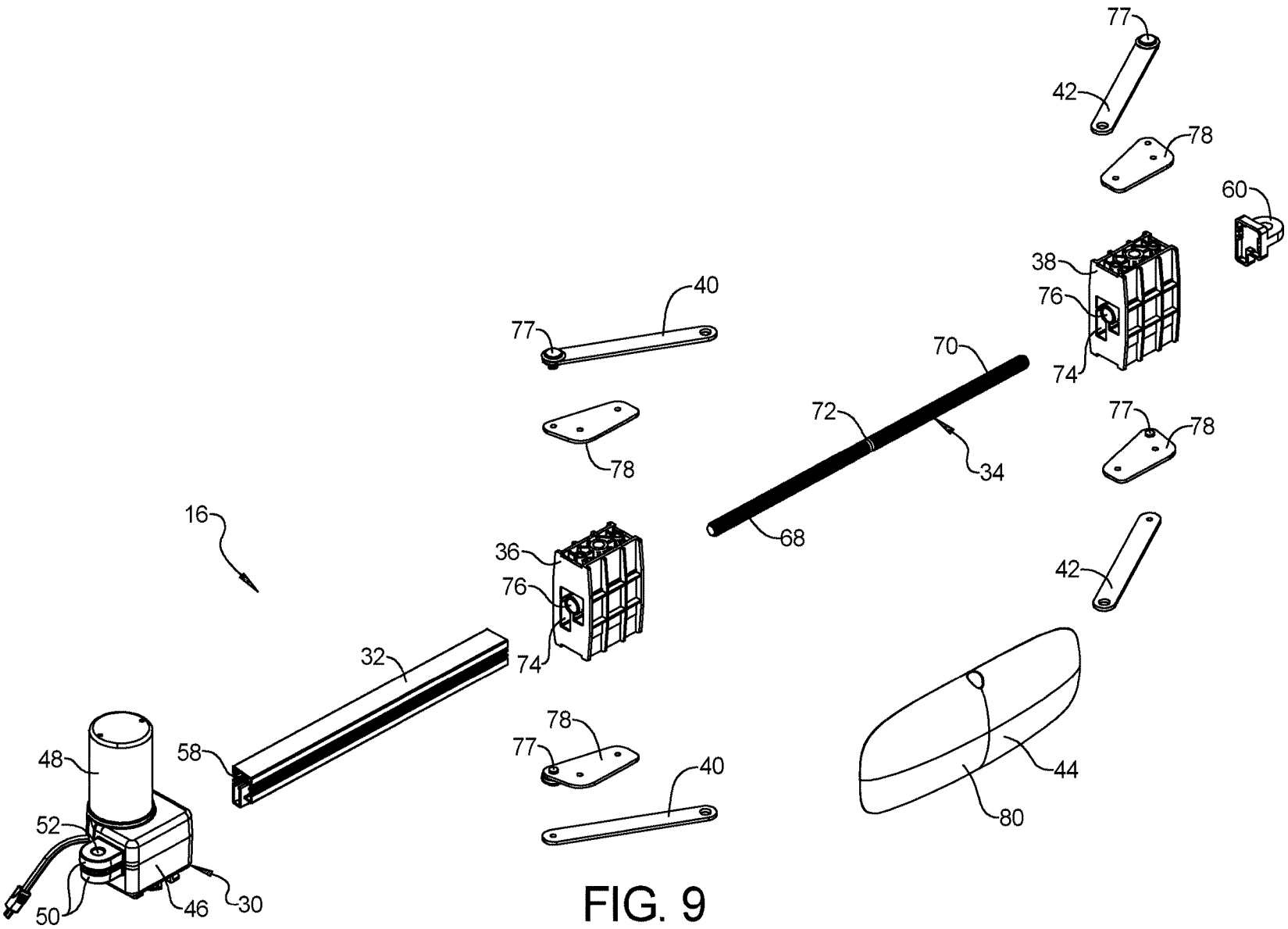
FIG. 9 is an exploded view of the lumbar adjustment assembly.
Figure 11:
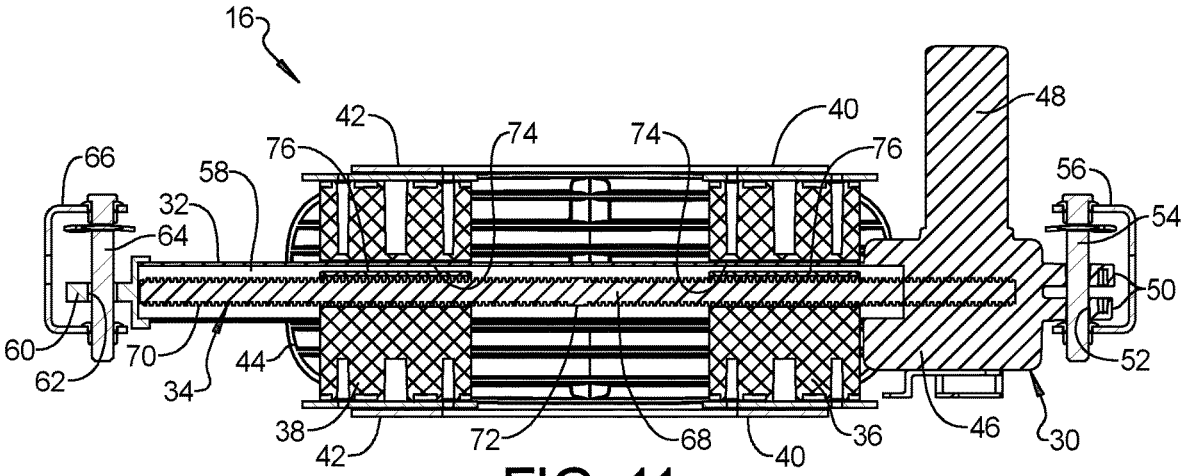
FIG. 11 is another cross-sectional view of the lumbar adjustment assembly.

The threaded rod 34 may be an elongated cylindrical rod that is coupled to the motor 48 and threadably engages the first and second slider blocks 36, 38. As shown in FIGS. 9 and 11, the threaded rod 34 may include a first threaded section 68 and a second threaded section 70. The first threaded section 68 and the second threaded section 70 may have threads of opposite handedness. For example, the first threaded section 68 may have right-handed threads and the second threaded section 70 may have left-handed threads, or the first threaded section 68 may have left-handed threads and the second threaded section 70 may have right-handed threads.

The threaded rod 34 may include an intermediate section 72 (FIGS. 9 and 11) disposed between the first and second threaded sections 68, 70. The intermediate section 72 defines a transitional portion of the threaded rod 34 between the first and second threaded sections 68, 70. In some configurations, the intermediate section 72 may be unthreaded. The first threaded section 68 may extend between the motor assembly 30 and the intermediate section 72 and may threadably engage the first slider block 36. The second threaded section 70 may threadably engage the first slider block 36 and may extend between the intermediate section 72 and the mounting projection 60 attached to the second lateral support member 28.

The opposite handedness of the first and second threaded portions 68, 70 causes the first and second slider blocks 36, 38 to move in opposite directions while the threaded rod 34 rotates. That is, rotation of the threaded rod 34 in one direction causes the first and second slider blocks 36, 38 to move toward each other along the rail 32, and rotation of the threaded rod 34 in the opposite direction causes the first and second slider blocks 36, 38 to move away from each other along the rail 32.

Figure 10:
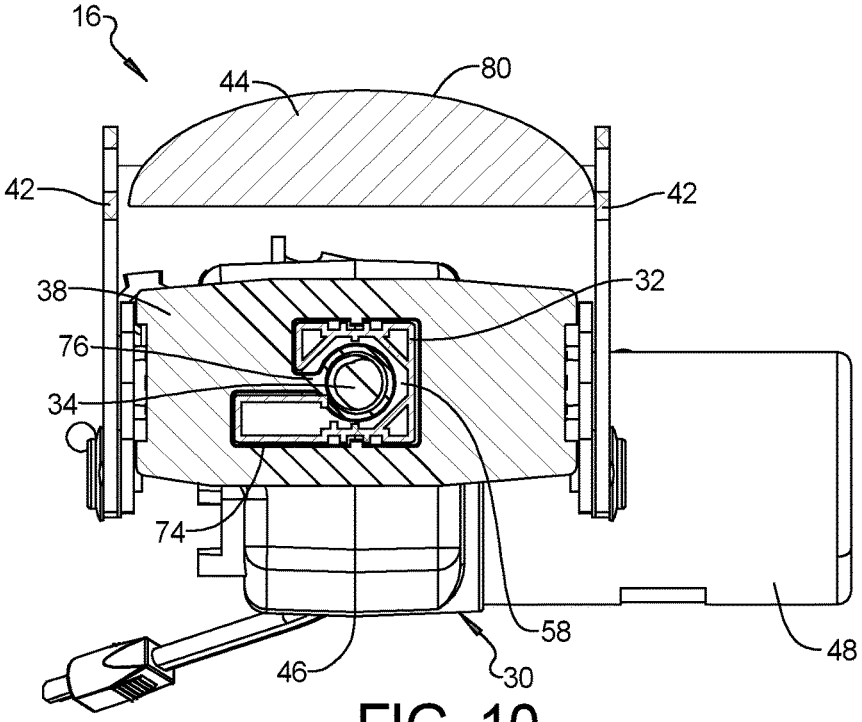
FIG. 10 is a cross-sectional view of the lumbar adjustment assembly.

The first and second slider blocks 36, 38 may be similar or identical to each other and may each include a channel 74 that movably receives the rail 32. As shown in FIG. 10, the channel 74 has a cross-sectional shape that substantially matches the outer cross-sectional shape of the rail 32. In this manner, the first and second slider blocks 36, 38 can slide along the rail 32.

As shown in FIG. 10, each of the first and second slider blocks 36, 38 may include a nut portion 76 that extends from a main body of the slider block 36, 38 into the channel 74 and threadably engages the threaded rod 34. That is, the nut portion 76 includes a threaded aperture through which the threaded rod 34 is threadably received. The nut portion 76 of the first slider block 36 threadably engages the first threaded section 68 of the threaded rod 34. The nut portion 76 of the second slider block 38 threadably engages the second threaded section 70 of the threaded rod 34. Therefore, the nut portions 76 of the first and second slider blocks 36, 38 have different threaded handedness (i.e., the nut portion 76 of the first slider block 36 has the same thread handedness as the first threaded section 68, and the nut portion 76 of the second slider block 38 has the same thread handedness as the second threaded section 70).

Since the cross-sectional shape of the channel 74 of the slider blocks 36, 38 substantially matches the cross-sectional shape of the rail 32, the rail 32 prevents the slider blocks 36, 38 from rotating with the threaded rod 34 and allows the slider blocks 36, 38 to slide along the rail 32 (in a direction along the longitudinal axis of the threaded rod 34) while the threaded rod 34 rotates relative to the rail 32. As described above, because the first and second threaded sections 68, 70 of the threaded rod 34 have threads of opposite handedness, rotation of the threaded rod 34 in one direction causes the first and second slider blocks 36, 38 to move toward each other along the rail 32, and rotation of the threaded rod 34 in the opposite direction causes the first and second slider blocks 36, 38 to move away from each other along the rail 32 (compare FIGS. 5 and 7 or FIGS. 6 and 8).

Figure 7:
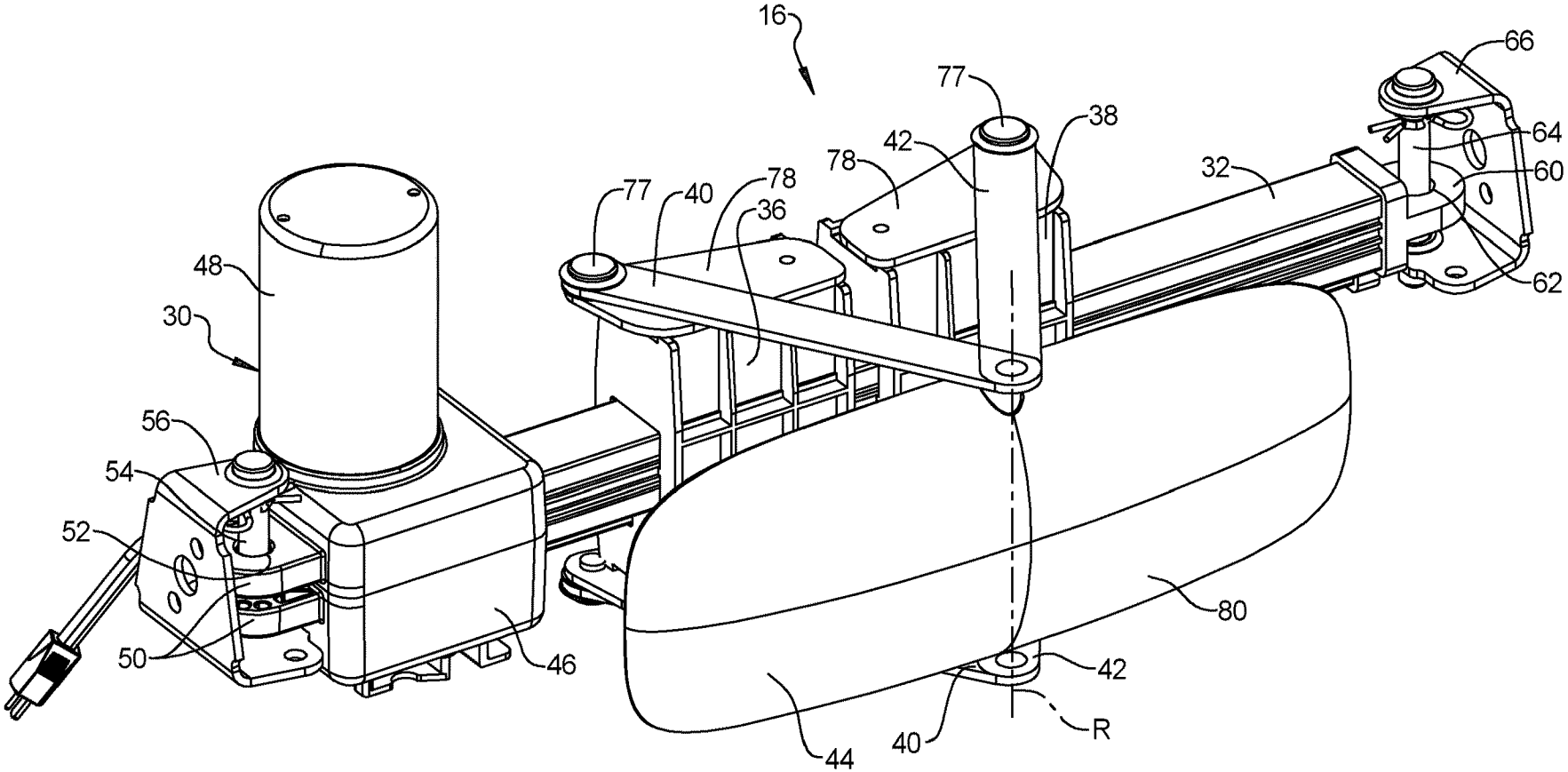
FIG. 7 is a perspective view of the lumbar adjustment assembly in an extended position.
Figure 8:
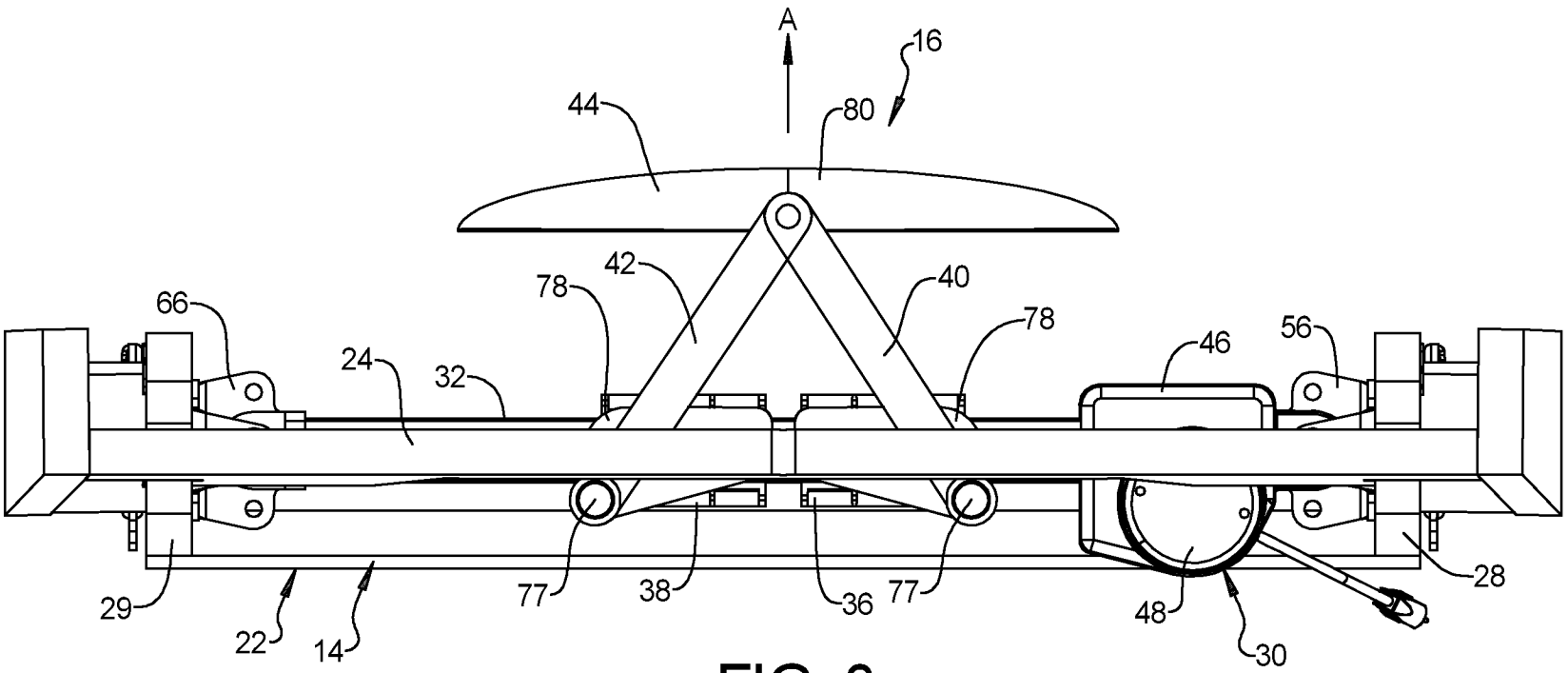
FIG. 8 is a top view of the seatback and lumbar adjustment assembly in the extended position.

The first links 40 and the second links 42 may be similar or identical to each other. As shown in FIGS. 5 and 7, first ends of the first links 40 are rotatably connected to the first slider block 36 (e.g., via pins 77) and second ends of the first links 40 are rotatably connected to the lumbar pad 44 (e.g., via pins or fasteners; not shown). First ends of the second links 42 are rotatably connected to the second slider block 38 (e.g., via pins 77) and second ends of the second links 42 are rotatably connected to the lumbar pad 44 (e.g., via pins or fasteners; not shown). In the configuration shown in the figures, bracket plates 78 (FIGS. 4 and 5) are fixedly attached (e.g., via threaded fasteners; not shown) to opposing sides of each of the slider blocks 36, 38. The links 40, 42 are rotatably attached to the bracket plates 78 (e.g., via pins 77). As shown in FIGS. 5 and 7, the first and second links 40, 42 may be coupled to the lumbar pad 44 along a common rotational axis R. In some configurations, however, the first links 40 may be coupled to the lumbar pad 44 along a first rotational axis, and the second links 42 may be coupled to the lumbar pad 44 along a second rotational axis that is spaced apart from the first rotational axis.

The lumbar pad 44 may be a relatively rigid member and may have a contoured support surface 80 (FIG. 5). The support surface 80 may be in contact with and/or adjacent to the padding and upholstery that covers the seatback 14. The lumbar adjustment assembly 16 may be positioned on the seatback frame 22 such that the support surface 80 corresponds to the lumbar support section 20 of the seatback 14 (i.e., the support surface 80 of the lumbar pad 44 supports the lumbar portion of a person's back who is sitting in the seating or furniture assembly 10).

With continued reference to FIGS. 1-11, operation of the lumbar adjustment assembly 16 will be described in detail. A user sitting in the seating or furniture assembly 10 can actuate the lumbar adjustment assembly 16 to adjust the position of the lumbar support section 20 of the seatback 14. Movement of the lumbar adjustment assembly 16 from the retracted position (FIGS. 5 and 6) to the extended position (FIGS. 7 and 8) causes the lumbar pad 44 to move in the lumbar extension direction A (FIG. 1); and movement of the lumbar adjustment assembly 16 from the extended position to the retracted position causes the lumbar pad 44 to move in the lumbar retraction direction B. Movement of the lumbar pad 44 toward the extended position moves the lumbar support section 20 (e.g., padding and/or upholstery covering the lumbar support section 20 of the seatback 14) in the lumbar extension direction A; and movement of the lumbar pad 44 toward the retracted position allows the lumbar support section 20 (e.g., the padding and/or upholstery covering the lumbar support section 20) to move in the lumbar retraction direction B.

To move the lumbar adjustment assembly 16 from the retracted position to the extended position, the user may press a button (not shown) or other switch or control interface located on the side of the seating or furniture assembly 10 or on a remote control (not shown), for example, to operate the motor 48 to drive the threaded rod 34 in a first rotational direction relative to the rail 32. As described above, rotation of the threaded rod 34 in the first rotational direction causes the first and second slider blocks 36, 38 to move linearly toward each other along the rail 32. As the first and second slider blocks 36, 38 move toward each other along the rail 32, the links 40, 42 rotate relative to the slider blocks 36, 38 and force the lumbar pad 44 to move linearly in the lumbar extension direction A (see FIG. 8). The lumbar extension direction A may be perpendicular to the direction in which the slider blocks 36, 38 move along the rail 32. In other configurations, the links 40, 42 could be configured such that the lumbar extension direction A extends at a non-perpendicular angle relative to the rail 32. In some configurations, the links 40, 42 could be configured such that the lumbar pad 44 moves in the lumbar extension direction A (i.e., away from the rail 32) when the first and second slider blocks 36, 38 move away from each other along the rail, and the lumbar pad 44 moves in the lumbar retraction direction B (i.e., toward from the rail 32) when the first and second slider blocks 36, 38 move toward each other along the rail 32.

To move the lumbar adjustment assembly 16 from the extended position to the retracted position, the user may press another button (not shown) on the side of the seating or furniture assembly 10 or on the remote control (not shown), for example, to operate the motor 48 to drive the threaded rod 34 in a second rotational direction (opposite the first rotational direction) relative to the rail 32. Rotation of the threaded rod 34 in the second rotational direction causes the first and second slider blocks 36, 38 to move linearly away from each other along the rail 32. As the first and second slider blocks 36, 38 move away from each other along the rail 32, the links 40, 42 rotate relative to the slider blocks 36, 38 and force the lumbar pad 44 to move linearly in the lumbar retraction direction B (see FIG. 6). The lumbar retraction direction B may be perpendicular to the direction in which the slider blocks 36, 38 move along the rail 32. In other configurations, the links 40, 42 could be configured such that the lumbar retraction direction B extends at a non-perpendicular angle relative to the rail 32.

In the particular example shown in FIGS. 1 and 2, the assembly 10 is a chair; however, the principles of the present disclosure are not limited to chairs. That is, the lumbar adjustment assembly 16 can be incorporated into a variety of types of seating or furniture assemblies including single or multiple person furniture members, sofas, sectional members, loveseats, vehicle seating, dental seating, medical seating, etc. Furthermore, in any given seating or furniture assembly, the lumbar adjustment assembly 16 may be one of a plurality of movable or adjustable portions of the seating or furniture assembly, or the lumbar adjustment assembly 16 could be the only movable or adjustable portion of the seating or furniture assembly.

While the lumbar adjustment assembly 16 is described above as being driven by the motor assembly 30, in some configurations, the lumbar adjustment assembly 16 could be manually driven.

Furthermore, while the threaded rod 34 shown in the figures is a single, unitary body, in some configurations, the threaded rod 34 could be formed by welding or otherwise attaching two rods (one rod corresponding to each of the first and second threaded sections 68, 70) together.

In some configurations, the threads of the first and second threaded sections 68, 70 have the same pitch. In other configurations, the threads of the first threaded section 68 may have a different pitch than the threads of the second threaded section 70. The different pitches of the threads of the first and second threaded sections 68, 70 can allow the first and second slider blocks 36, 38 to move at different speeds.

The links 40, 42 could be shaped, sized, oriented and connected to the slider blocks 36, 38 and lumbar pad 44 in any desired manner to produce any desired movement of the lumbar pad 44 (or multiple lumbar pads). Furthermore, the threaded rod 34, slider blocks 36, 38 and links 40, 42 could be configured to move additional or alternative components of a seating or furniture assembly (i.e., instead of or in addition to the lumbar pad 44).

Figure 12:
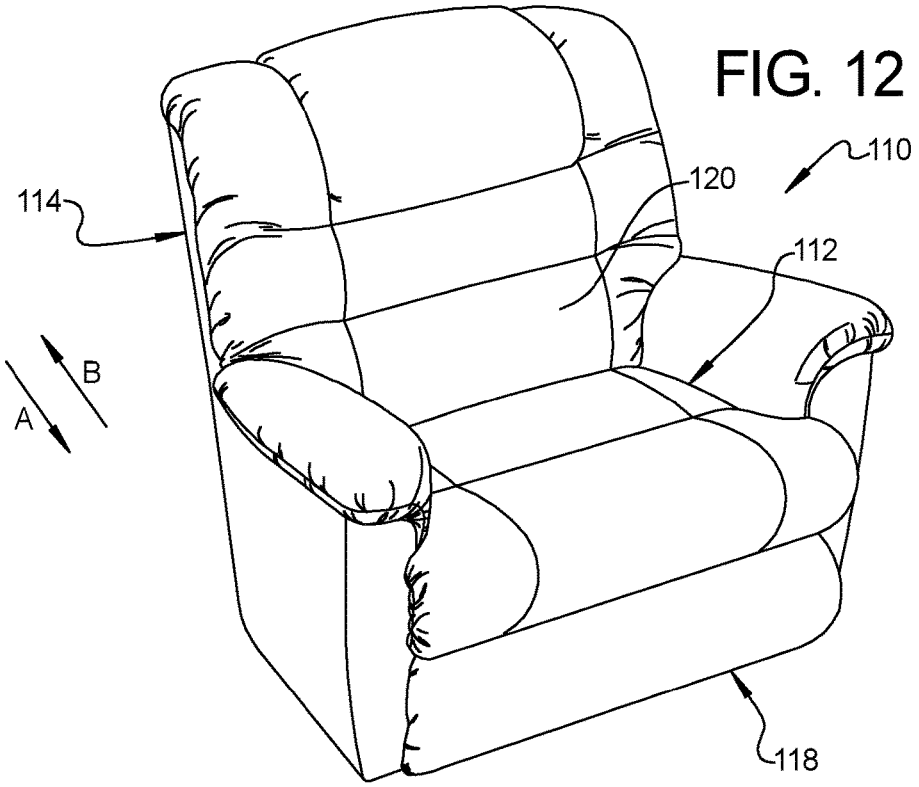
FIG. 12 is a perspective view of another furniture member with another legrest mechanism in a retracted position.
Figure 13:
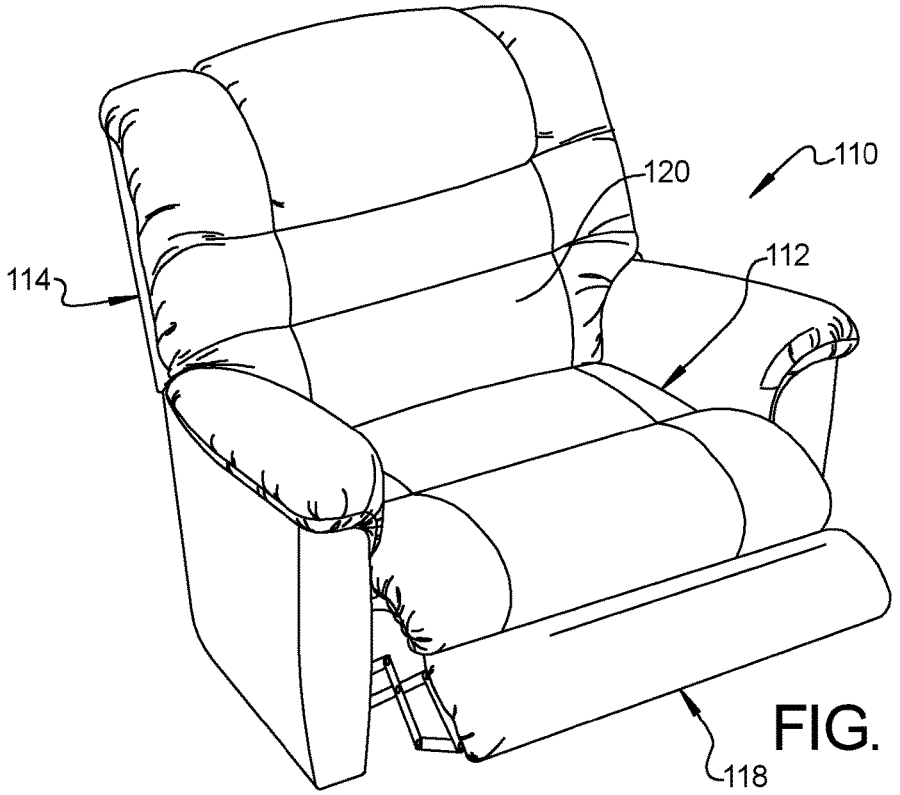
FIG. 13 is a perspective view of the furniture member of FIG. 12 with the legrest mechanism in an extended position.

With reference to FIGS. 12-22, a seating or furniture assembly 110 (FIGS. 12 and 13) is provided that may include a seat bottom 112, a seatback 114, and a lumbar adjustment mechanism or assembly 116 (FIGS. 14-22). In some configurations, the seatback 114 may be movable relative to the seat bottom 112 between reclined and upright positions. In some configurations, the seating or furniture assembly 110 may include a legrest assembly 118 that is movable relative to the seat bottom 112 between a retracted position (FIG. 12) and an extended position (FIG. 13). The seatback 114 includes a lumbar support section 120 in which the lumbar adjustment assembly 116 is disposed. As will be described in more detail below, the lumbar adjustment assembly 116 can be actuated to move the lumbar support section 120 of the seatback 114 in a lumbar extension direction A to increase occupant lumbar support or in a lumbar retraction direction B to decrease occupant lumbar support. The lumbar adjustment assembly 16 is operable independently of any other mechanism (e.g., a seatback reclining mechanism, tilting mechanism, movable headrest mechanism, or the legrest assembly 118) of the furniture assembly 110.

Figure 14:
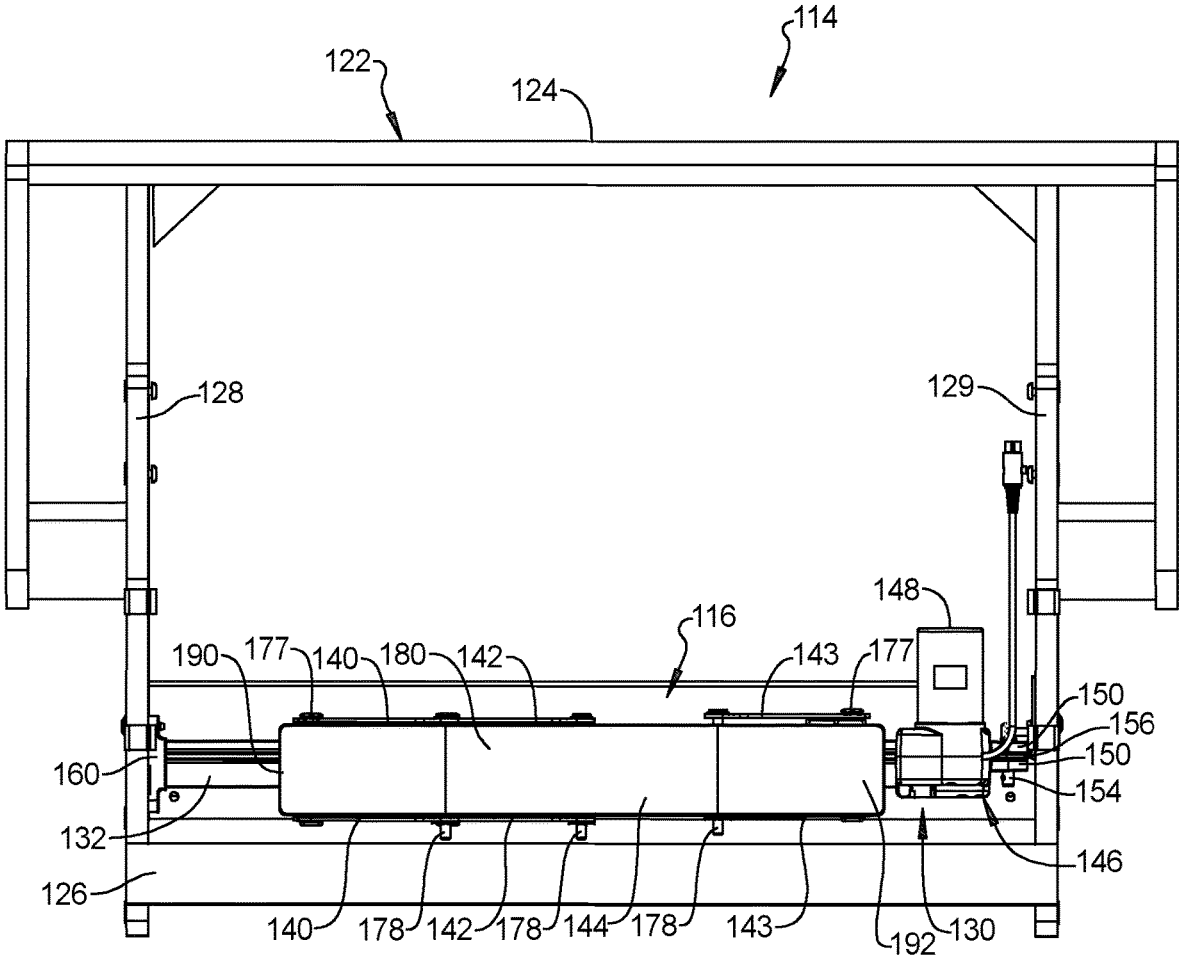
FIG. 14 is a front view of a seatback of the furniture member of FIG. 12 with upholstery and padding removed to show a lumbar adjustment assembly.
Figure 15:
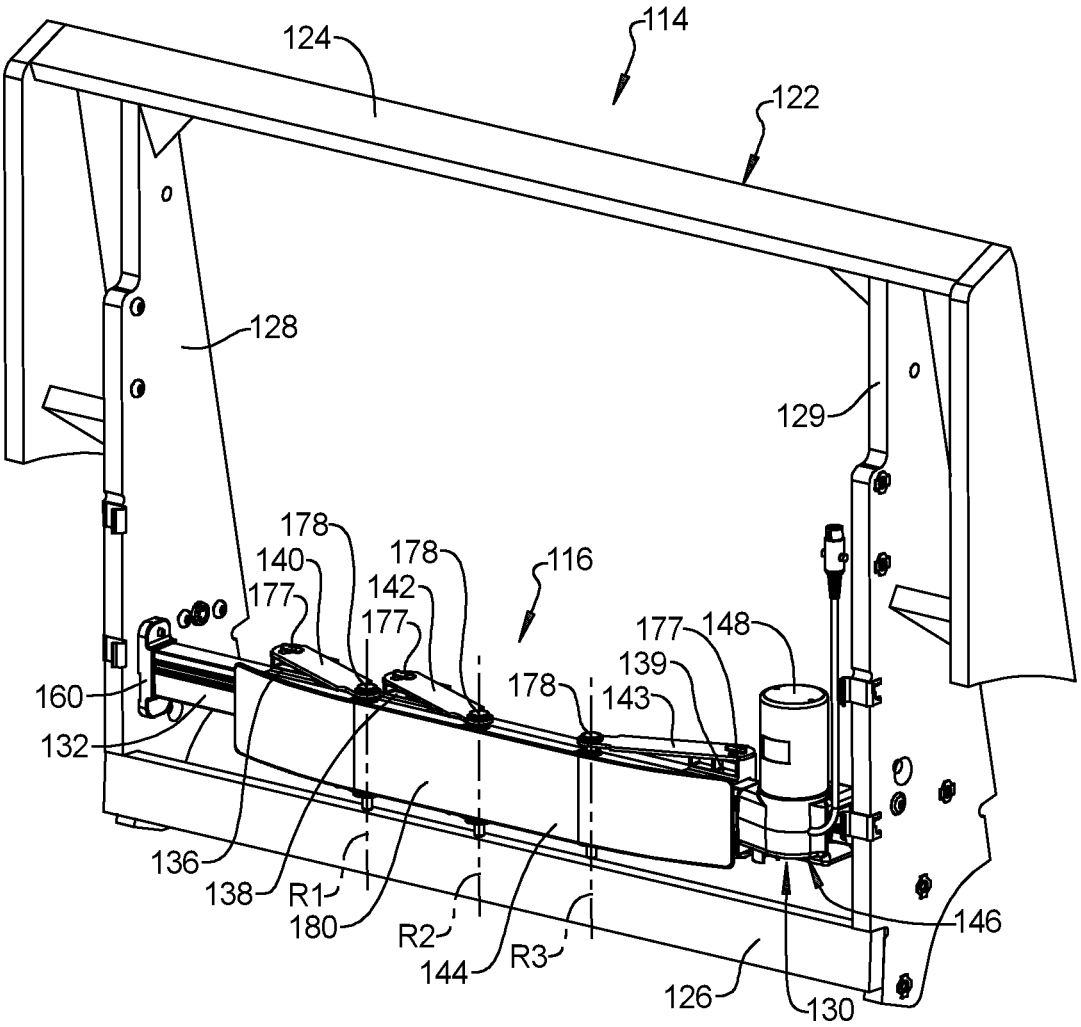
FIG. 15 is a perspective view of the seatback and lumbar adjustment assembly.

Referring now to FIGS. 14 and 15, the seatback 114 includes a seatback frame 122 (which, in FIGS. 12 and 13, is shown covered with padding and upholstery) that may have an upper cross member 124, a lower cross member 126 (i.e., the end adjacent the seat bottom 112 when the seating or furniture assembly 110 is fully assembled), and first and second lateral support members 128, 129 extending between the upper and lower cross members 124, 126. The lumbar adjustment assembly 116 may be mounted to the first and second lateral support members 128, 129. The lumbar adjustment assembly 116 may be disposed between the upper and lower cross members 124, 126 at a location corresponding to the lumbar support section 120 (FIGS. 12 and 13) of the seatback 114.

As shown in FIGS. 14-22, the lumbar adjustment assembly 116 may include a motor assembly 130, a rail 132, a threaded rod 134 (FIGS. 20-22), a first slider block 136, a second slider block 138, a third slider block 139, a pair of first links 140, a pair of second links 142, a pair of third links 143, and a support member (e.g., a lumbar pad) 144. The motor assembly 130 may include a housing 146 and a motor 148. The housing 146 may include one or more mounting projections 150 each having an aperture 152 (FIG. 5). A connecting pin 154 (FIG. 14) may extend through the aperture(s) 152 and engage a mounting bracket 156 that is fixedly attached to the second lateral support member 129. It will be appreciated that the motor assembly 130 could be mounted to the seatback 114 in any suitable manner.

Figure 16:
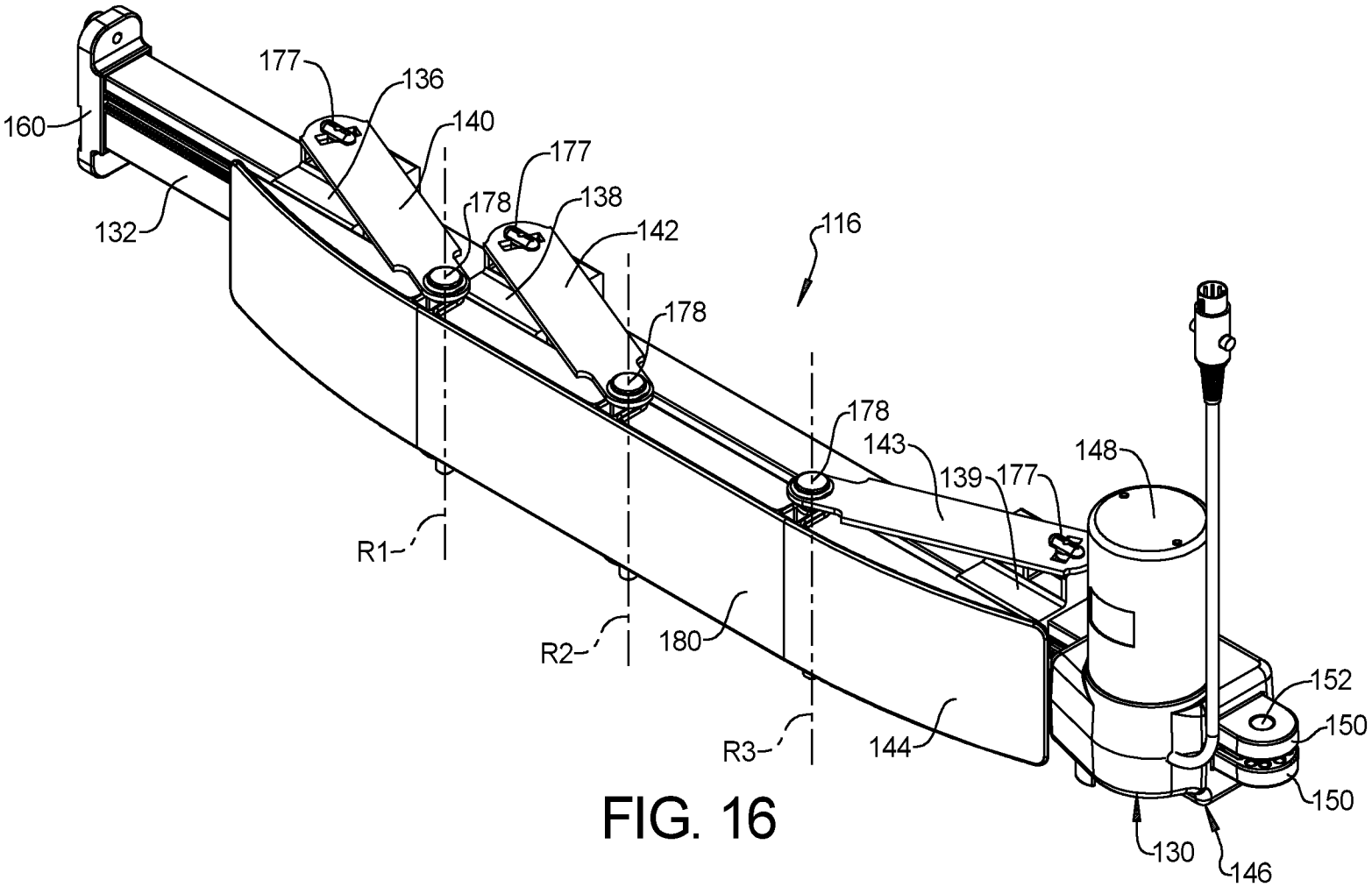
FIG. 16 is a perspective view of the lumbar adjustment assembly in a retracted position.
Figure 17:
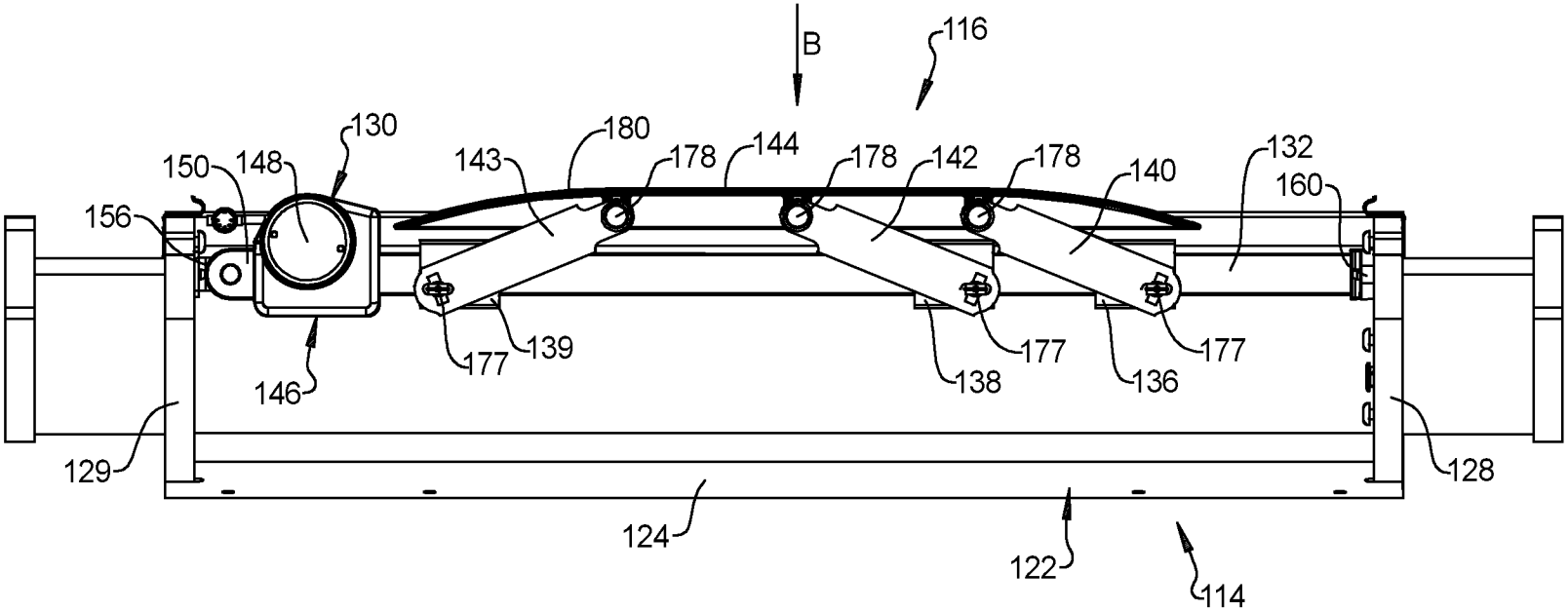
FIG. 17 is a top view of the seatback and lumbar adjustment assembly in the retracted position.

The motor 148 may be attached to and/or disposed at least partially within the housing 146. The motor 148 may be operatively coupled (e.g., via one or more output shafts disposed in the motor housing 146 and, in some configurations, via gears and/or other couplings) to the threaded rod 134 such that operation of the motor 148 causes rotation of the threaded rod 134 about a longitudinal axis of the threaded rod 134. As will be described in more detail below, operation of the motor 148 in a first direction causes the lumbar pad 144 to move relative to the seatback 114 in the lumbar extension direction A toward an extended position (FIGS. 18 and 19), and operation of the motor 148 in a second direction causes the lumbar pad 144 to move relative to the seatback 114 in the lumbar retraction direction B toward a retracted position (FIGS. 16 and 17).

The rail 132 may be an elongated member that defines an internal cavity 158 (FIGS. 21 and 22) in which the threaded rod 134 is disposed. One end of the rail 132 may be fixedly attached to the housing 146 and another end of the rail 132 may include or be attached to a mounting bracket 160. The mounting bracket 160 may be fixedly attached to the first lateral support member 128.

Figure 20:
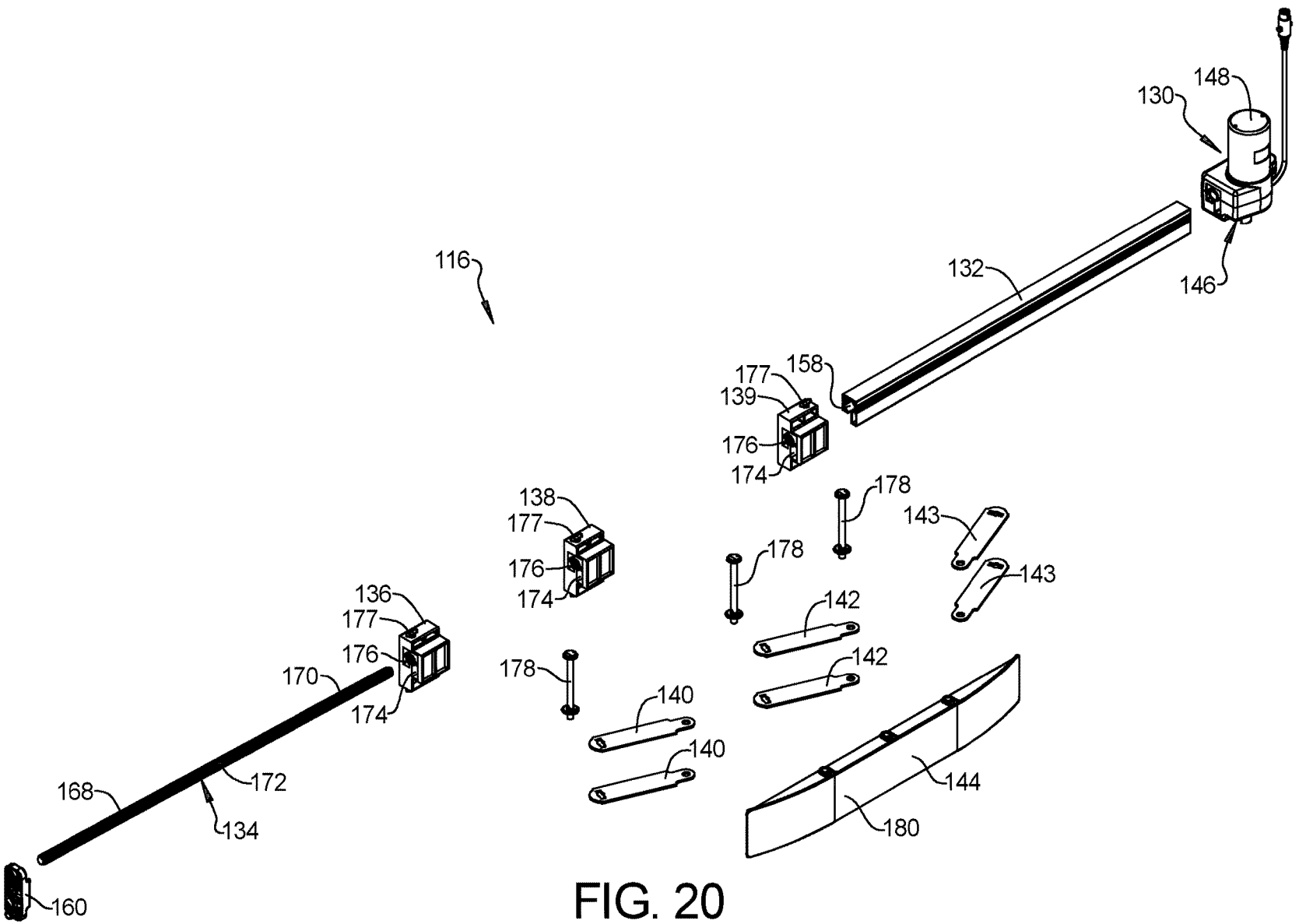
FIG. 20 is an exploded view of the lumbar adjustment assembly.
Figure 22:
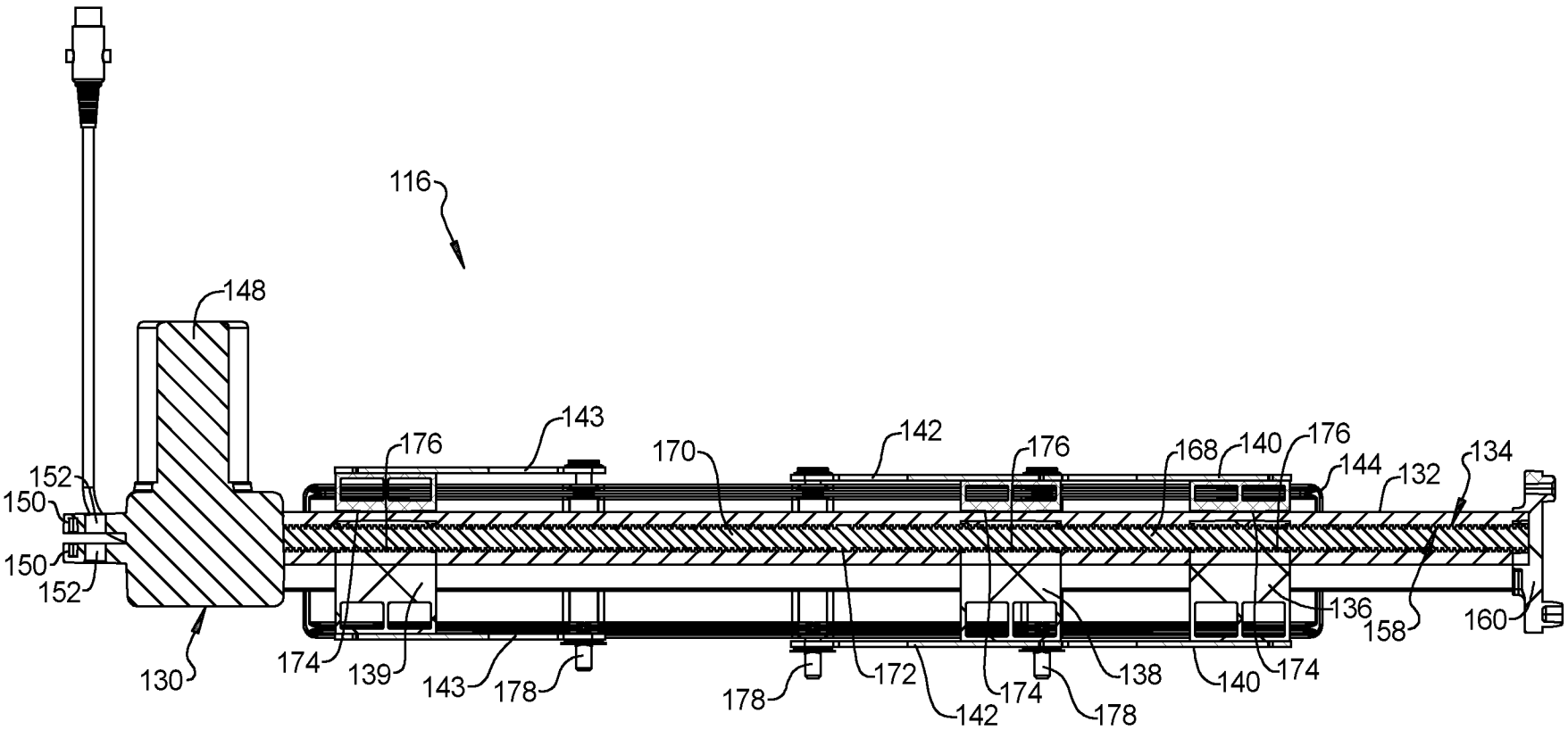
FIG. 22 is another cross-sectional view of the lumbar adjustment assembly.

The threaded rod 134 may be an elongated cylindrical rod that is coupled to the motor 148 and threadably engages the first, second and third slider blocks 136, 138, 139. As shown in FIGS. 20 and 22, the threaded rod 134 may include a first threaded section 168 and a second threaded section 170. The first threaded section 168 and the second threaded section 170 may have threads of opposite handedness. For example, the first threaded section 168 may have right-handed threads and the second threaded section 170 may have left-handed threads, or the first threaded section 168 may have left-handed threads and the second threaded section 170 may have right-handed threads.

The threaded rod 134 may include an intermediate section 172 (FIGS. 20 and 22) disposed between the first and second threaded sections 168, 170. The intermediate section 172 defines a transitional portion of the threaded rod 134 between the first and second threaded sections 168, 170. In some configurations, the intermediate section 172 may be unthreaded. The first threaded section 168 may extend between the motor assembly 130 and the intermediate section 172 and may threadably engage the third slider block 139. The second threaded section 170 may threadably engage the first and second slider blocks 136, 138 and may extend between the intermediate section 172 and the mounting bracket 160 attached to the second lateral support member 128.

Due to the opposite handedness of the first and second threaded portions 168, 170, when the threaded rod 134 rotates, the first and second slider blocks 136, 138 to move in a direction opposite a direction of movement of the third slider block 139. That is, rotation of the threaded rod 134 in one direction causes the first, second and third slider blocks 136, 138, 139 to move along the rail 132 toward the intermediate section 172 (i.e., the first and second slider blocks 136, 138 move toward the third slider block 139 and the third slider block 139 moves toward the first and second slider blocks 136, 138), and rotation of the threaded rod 134 in the opposite direction causes the first, second and third slider blocks 136, 138, 139 to move away from the intermediate section 172 along the rail 132 (i.e., the first and second slider blocks 136, 138 move away from the third slider block 139 and the third slider block 139 moves away from the first and second slider blocks 136, 138).

Figure 21:
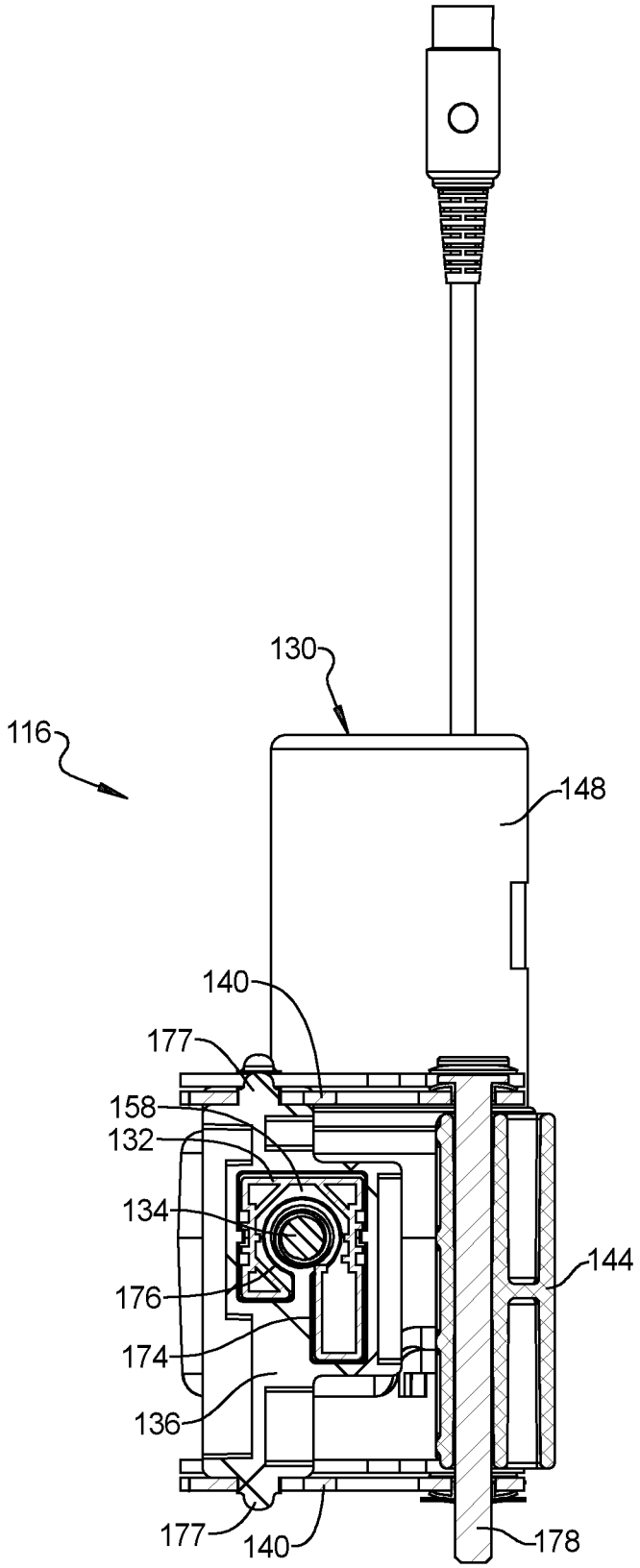
FIG. 21 is a cross-sectional view of the lumbar adjustment assembly.

The first, second and third slider blocks 136, 138, 139 may be similar or identical to each other and may each include a channel 174 that movably receives the rail 132. As shown in FIG. 21, the channel 174 has a cross-sectional shape that substantially matches the outer cross-sectional shape of the rail 132. In this manner, the first, second and third slider blocks 136, 138, 139 can slide along the rail 132.

As shown in FIG. 21, each of the first, second, and third slider blocks 136, 138, 139 may include a nut portion 176 that extends from a main body of the slider block 136, 138, 139 into the channel 174 and threadably engages the threaded rod 134. That is, the nut portion 176 includes a threaded aperture through which the threaded rod 134 is threadably received. The nut portions 176 of the first and second slider blocks 136, 138 threadably engage the first threaded section 168 of the threaded rod 134. The nut portion 176 of the third slider block 139 threadably engages the second threaded section 170 of the threaded rod 134. Therefore, the nut portions 176 of the first and second slider blocks 136, 138 have different threaded handedness than the nut portion 176 of the third slider block 139 (i.e., the nut portions 176 of the first and second slider blocks 136, 138 have the same thread handedness as the first threaded section 168, and the nut portion 176 of the third slider block 139 has the same thread handedness as the second threaded section 170).

Since the cross-sectional shape of the channels 174 of the slider blocks 136, 138, 139 substantially matches the cross-sectional shape of the rail 132, the rail 132 prevents the slider blocks 136, 138, 139 from rotating with the threaded rod 134 and allows the slider blocks 136, 138, 139 to slide along the rail 132 (in a direction along the longitudinal axis of the threaded rod 134) while the threaded rod 134 rotates relative to the rail 132. As described above, because the first and second threaded sections 168, 170 of the threaded rod 134 have threads of opposite handedness, rotation of the threaded rod 134 in one direction causes the first and second slider blocks 136, 138 to move toward the third slider block 139 along the rail 132 (and the third slider block 139 moves toward the first and second slider blocks 136, 138 along the rail 132), and rotation of the threaded rod 134 in the opposite direction causes the first and second slider blocks 136, 138 to move away from the third slider block 139 along the rail 132 (and the third slider block 139 moves away from the first and second slider blocks 136, 138 along the rail 132) (compare FIGS. 16 and 18 or FIGS. 17 and 19).

Figure 18:
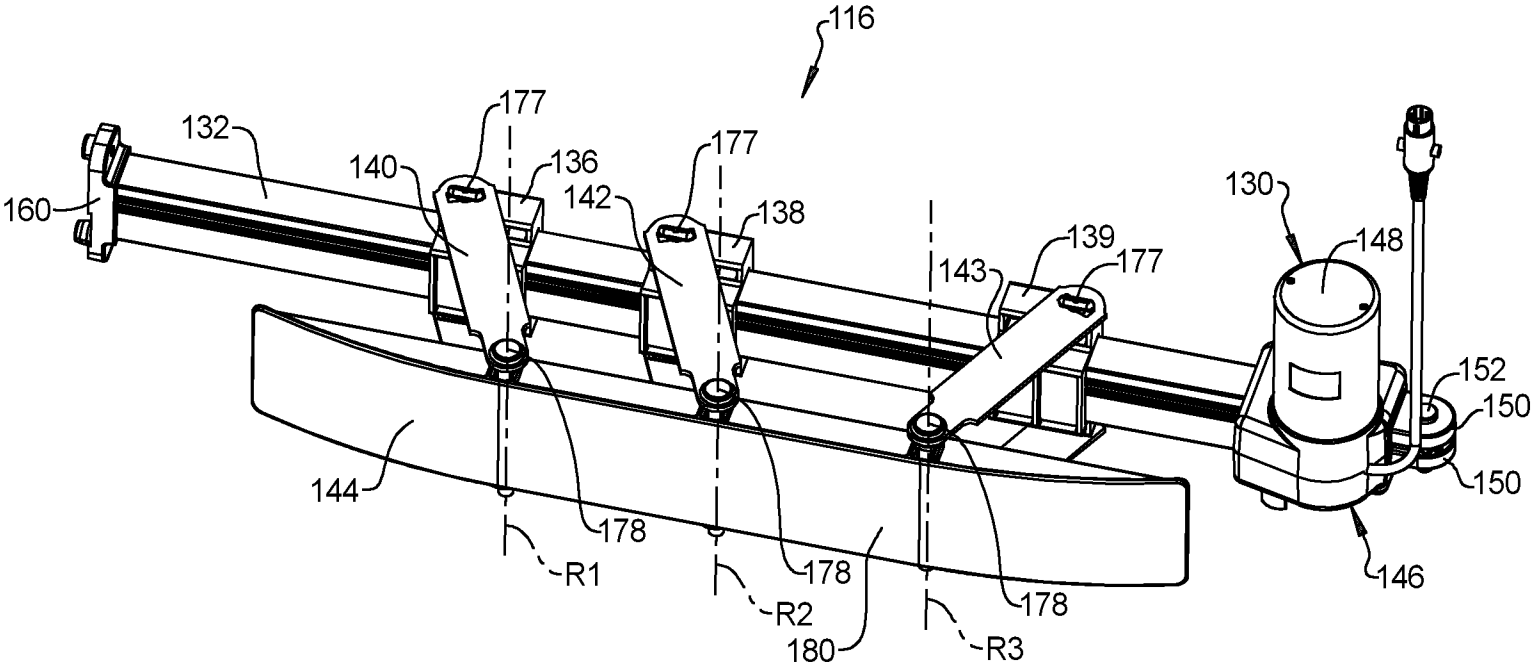
FIG. 18 is a perspective view of the lumbar adjustment assembly in an extended position.
Figure 19:
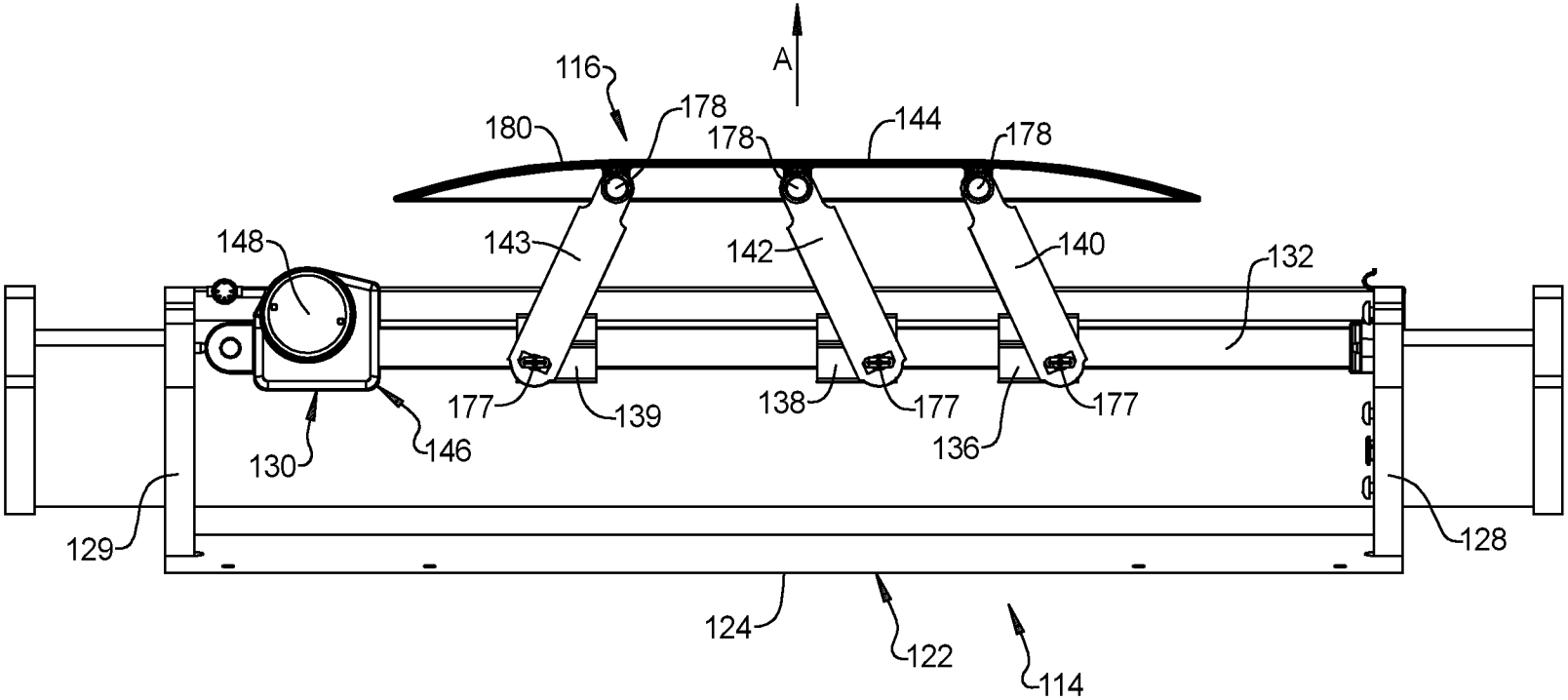
FIG. 19 is a top view of the seatback and lumbar adjustment assembly in the extended position.

The first, second, and third links 140, 142, 143 may be similar or identical to each other. As shown in FIGS. 16 and 18, first ends of the first links 140 are rotatably connected to the first slider block 136 (e.g., via pins or protrusions 177) and second ends of the first links 140 are rotatably connected to the lumbar pad 144 (e.g., via pins or fasteners 178). First ends of the second links 142 are rotatably connected to the second slider block 138 (e.g., via pins or protrusions 717) and second ends of the second links 142 are rotatably connected to the lumbar pad 144 (e.g., via pins or fasteners 178). First ends of the third links 143 are rotatably connected to the third slider block 139 (e.g., via pins or protrusions 177) and second ends of the third links 143 are rotatably connected to the lumbar pad 144 (e.g., via pins or fasteners 178). As shown in FIGS. 16 and 18, the first, second, and third links 140, 142, 143 may be coupled to the lumbar pad 144 at first, second, and third rotational axes R1, R2, R3, respectively. The first, second, and third rotational axes R1, R2, R3 are parallel to each other and spaced apart from each other.

The lumbar pad 144 may be a relatively rigid member and may have a contoured support surface 180 (FIG. 16). The support surface 180 may be in contact with and/or adjacent to the padding and upholstery that covers the seatback 114. The lumbar adjustment assembly 116 may be positioned on the seatback frame 122 such that the support surface 180 corresponds to the lumbar support section 120 of the seatback 114 (i.e., the support surface 180 of the lumbar pad 144 supports the lumbar portion of a person's back who is sitting in the seating or furniture assembly 110).

With continued reference to FIGS. 12-22, operation of the lumbar adjustment assembly 116 will be described in detail. A user sitting in the seating or furniture assembly 110 can actuate the lumbar adjustment assembly 116 to adjust the position of the lumbar support section 120 of the seatback 114. Movement of the lumbar adjustment assembly 116 from the retracted position (FIGS. 16 and 17) to the extended position (FIGS. 18 and 19) causes the lumbar pad 144 to move in the lumbar extension direction A (FIG. 12); and movement of the lumbar adjustment assembly 116 from the extended position to the retracted position causes the lumbar pad 144 to move in the lumbar retraction direction B. Movement of the lumbar pad 144 toward the extended position moves the lumbar support section 120 (e.g., padding and/or upholstery covering the lumbar support section 120 of the seatback 114) in the lumbar extension direction A; and movement of the lumbar pad 144 toward the retracted position allows the lumbar support section 120 (e.g., the padding and/or upholstery covering the lumbar support section 120) to move in the lumbar retraction direction B.

To move the lumbar adjustment assembly 116 from the retracted position to the extended position, the user may press a button (not shown) or other switch or control interface located on the side of the seating or furniture assembly 110 or on a remote control (not shown), for example, to operate the motor 148 to drive the threaded rod 134 in a first rotational direction relative to the rail 132. As described above, rotation of the threaded rod 134 in the first rotational direction causes the first and second slider blocks 136, 138 to move toward the third slider block 139 and the third slider block 139 to move toward the first and second slider blocks 136, 138. As the first and second slider blocks 136, 138 move toward each other along the rail 132, the links 140, 142, 143 rotate relative to the slider blocks 136, 138, 139 and force the lumbar pad 144 to move linearly in the lumbar extension direction A (e.g., from the retracted position to the extended position) (see FIG. 19). The lumbar extension direction A may be perpendicular to the direction in which the slider blocks 136, 138, 139 move along the rail 132. In other configurations, the links 140, 142, 143 could be configured such that the lumbar extension direction A extends at a non-perpendicular angle relative to the rail 132.

To move the lumbar adjustment assembly 116 from the extended position to the retracted position, the user may press another button (not shown) on the side of the seating or furniture assembly 110 or on the remote control (not shown), for example, to operate the motor 148 to drive the threaded rod 134 in a second rotational direction (opposite the first rotational direction) relative to the rail 132. Rotation of the threaded rod 134 in the second rotational direction causes the first and second slider blocks 136, 138 to move away from the third slider block 139 and the third slider block 139 to move away from the first and second slider blocks 136, 138. As the first and second slider blocks 136, 138 move in a direction opposite the third slider block 139 along the rail 132, the links 140, 142, 143 rotate relative to the slider blocks 136, 138, 139 and force the lumbar pad 144 to move linearly in the lumbar retraction direction B (see FIG. 17). The lumbar retraction direction B may be perpendicular to the direction in which the slider blocks 136, 138, 139 move along the rail 132. In other configurations, the links 140, 142, 143 could be configured such that the lumbar retraction direction B extends at a non-perpendicular angle relative to the rail 132.

As described above, the slider blocks 136, 138, 139 are connected to the lumbar pad 144 via links 140, 142, 143 at three spaced-apart locations (i.e., at the first, second, and third rotational axes R1, R2, R3) along a length of the lumbar pad 144. This configuration provides adequate support for the lumbar pad 144 along the entire length of the lumbar pad 144 so that a load applied to the any point on the surface 180 of the lumbar pad 144 can be adequately supported so that undesired movement or deflection of the lumbar pad 144 is reduced or eliminated. This may be particularly beneficial for a lumbar adjustment assembly 116 mounted in a wide seat assembly 114. For example, the furniture assembly 110 shown in FIGS. 12 and 13 is an oversized or extra-wide chair (also known as a "chair-and-a-half"). The three slider blocks 136, 138, 139 and three pairs of links 140, 142, 143 supporting the extra-wide lumbar pad 144 in an extra-wide chair (or in an extra-wide backrest assembly 114 in a sofa, for example) adequately supports the lumbar pad 144 and reduces or prevents undesired movement of deflection of the lumbar pad 144 when subjected to a load at or near opposing ends 190, 192 (FIG. 14) of the lumbar pad 144.

In the particular example shown in FIGS. 12 and 13, the assembly 110 is a chair (e.g., an oversized chair); however, the principles of the present disclosure are not limited to chairs. That is, the lumbar adjustment assembly 116 can be incorporated into a variety of types of seating or furniture assemblies including single or multiple person furniture members, sofas, sectional members, loveseats, vehicle seating, dental seating, medical seating, etc. Furthermore, in any given seating or furniture assembly, the lumbar adjustment assembly 116 may be one of a plurality of movable or adjustable portions of the seating or furniture assembly, or the lumbar adjustment assembly 116 could be the only movable or adjustable portion of the seating or furniture assembly.

While the lumbar adjustment assembly 116 is described above as being driven by the motor assembly 130, in some configurations, the lumbar adjustment assembly 116 could be manually driven.

Furthermore, while the threaded rod 134 shown in the figures is a single, unitary body, in some configurations, the threaded rod 134 could be formed by welding or otherwise attaching two rods (one rod corresponding to each of the first and second threaded sections 168, 170) together.

In some configurations, the threads of the first and second threaded sections 168, 170 have the same pitch. In other configurations, the threads of the first threaded section 168 may have a different pitch than the threads of the second threaded section 170. The different pitches of the threads of the first and second threaded sections 168, 170 can allow the first and second slider blocks 136, 138 to move at a different speed than the third slider block 139.

The links 140, 142, 143 could be shaped, sized, oriented and connected to the slider blocks 136, 138, 139 and lumbar pad 144 in any desired manner to produce any desired movement of the lumbar pad 144 (or multiple lumbar pads). Furthermore, the threaded rod 134, slider blocks 136, 138, 139 and links 140, 142, 143 could be configured to move additional or alternative components of a seating or furniture assembly (i.e., instead of or in addition to the lumbar pad 144).

While the first and second slider blocks 136, 138 are described above as being engaged with the first threaded section 168 of the threaded rod 134 and the third slider block 139 is described above a being engaged with the second threaded section 170, in some configurations of the assembly 116, two of the slider blocks 136, 138, 139 may be disposed on the second threaded section 170 and one of the blocks 136, 138, 139 could be on the first threaded section 168. Furthermore, in some configurations of the assembly 116, there could be more than three slider blocks or fewer than three slider blocks. For example, the assembly 116 could include only two slider blocks (e.g., one on each of the threaded sections 168, 170). As another example, the assembly 116 could include four (or more) slider blocks (one or more slider blocks on the first threaded section 168 and one or more slider blocks on the second threaded section 170). Regardless of the number of slider blocks in the assembly 116, each slider block may be coupled to the lumbar pad 144 by one or more links (e.g., like links 140, 142, 143). Furthermore, while the section of the threaded rod 134 that is adjacent to motor assembly 130 is referred to above and in the figures as "the second threaded section 170," the section of the threaded rod 134 that is adjacent to motor assembly 130 could be termed "the first threaded section 168."

Furthermore, while the assembly 116 is described above as being a lumbar adjustment assembly 116, in some configurations, the assembly 116 could be a movable headrest assembly (e.g., where the support member 144 is a headrest support member), a movable footrest assembly (e.g., where the support member 144 is a footrest support member), movable legrest assembly (e.g., where the support member 144 is a legrest support member), or a movable armrest assembly (e.g., where the support member 144 is a armrest support member), for example.

Figure 27:
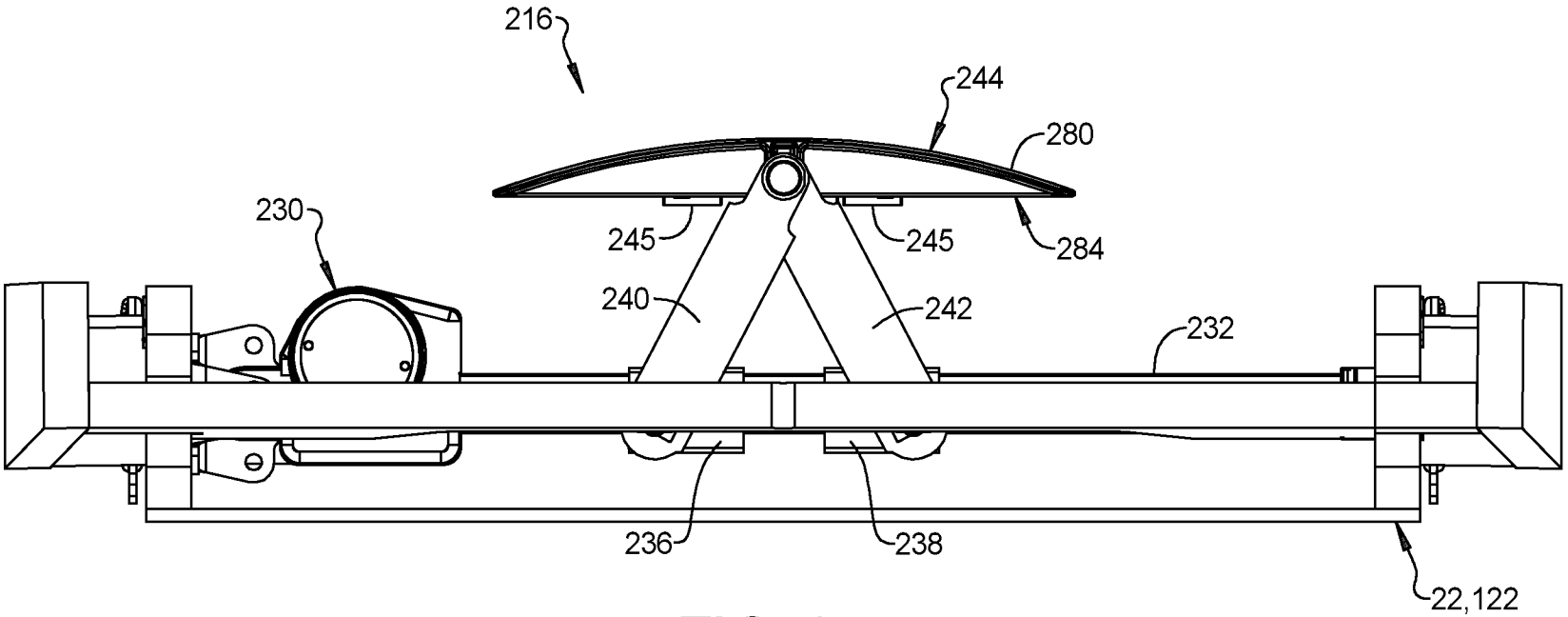
FIG. 27 is a top view of a seatback frame of a furniture member having the lumbar adjustment assembly of FIG. 23 in an extended position.

With reference to FIGS. 23-27, another lumbar adjustment assembly 216 is provided. The lumbar adjustment assembly 216 can be similar or identical to either of the lumbar adjustment assembly 16 or 116, except the lumbar adjustment assembly 216 includes one or more massaging units 245. The lumbar adjustment assembly 216 can be incorporated into a furniture assembly 10, 110. As shown in FIG. 27, the lumbar adjustment assembly 216 can be mounted to the seatback frame 22, 122 of the seatback 14, 114. In other configurations, the assembly 216 could be a movable headrest assembly, a movable footrest assembly, movable legrest assembly, or a movable armrest assembly, for example.

Figure 23:
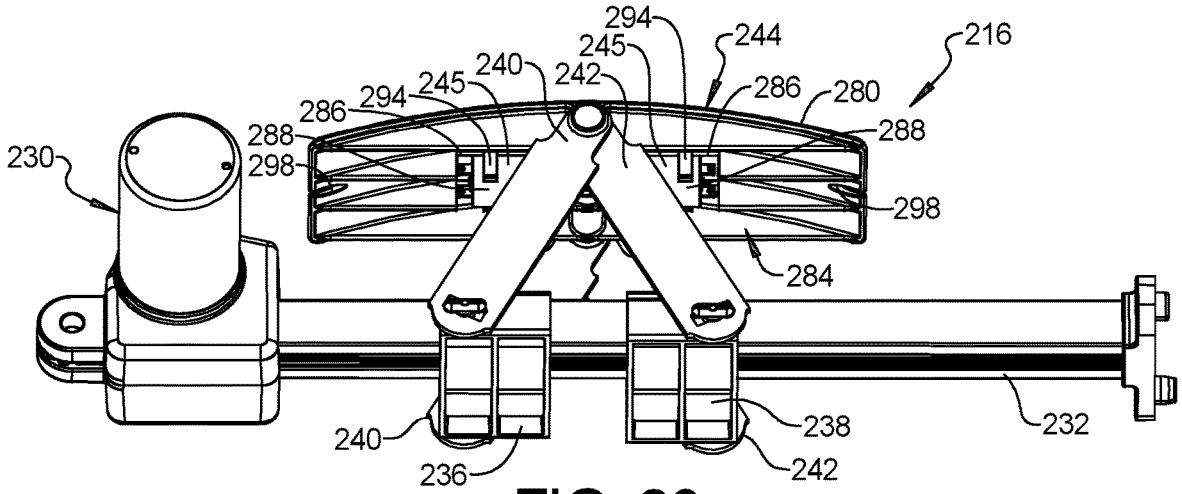
FIG. 23 is a perspective view of yet another lumbar adjustment assembly.

As shown in FIG. 23, the lumbar adjustment assembly 216 may include a motor assembly 230, a rail 232, a threaded rod (not shown; similar or identical to threaded rod 34, 134), a first slider block 236, a second slider block 238, a pair of first links 240, a pair of second links 242, a support member (e.g., a lumbar pad) 244, and the massaging units 245. The structure and function of the motor assembly 230, rail 232, threaded rod, slider blocks 236, 238, and links 240, 242 may be similar or identical to that of the motor assembly 30, 130, rail 32, 132, threaded rod 34, 134, slider blocks 36, 38, 136, 139, and links 40, 42, 140, 143 described above. The lumbar pad 244 may be similar or identical to the lumbar pad 44, 144 described above, apart from differences described below and/or shown in the figures.

Figure 25:
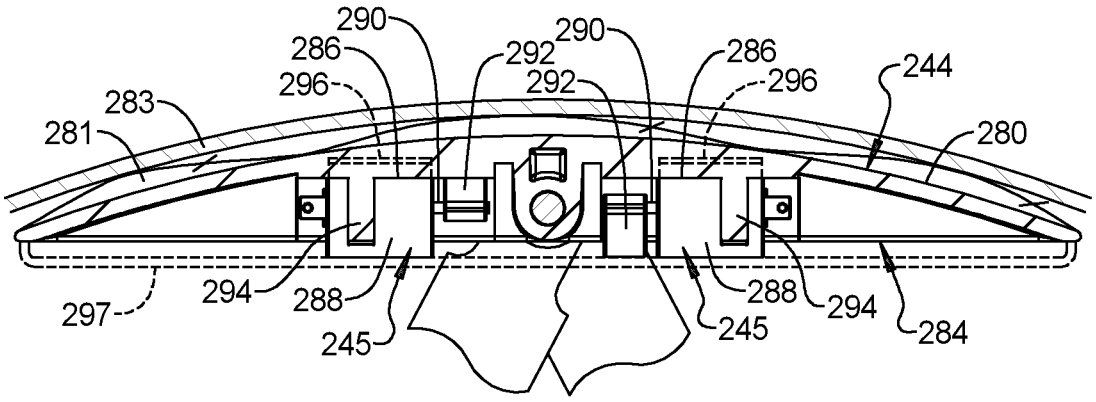
FIG. 25 is a side view of the lumbar pad of the lumbar adjustment assembly of FIG. 23.
Figure 26:
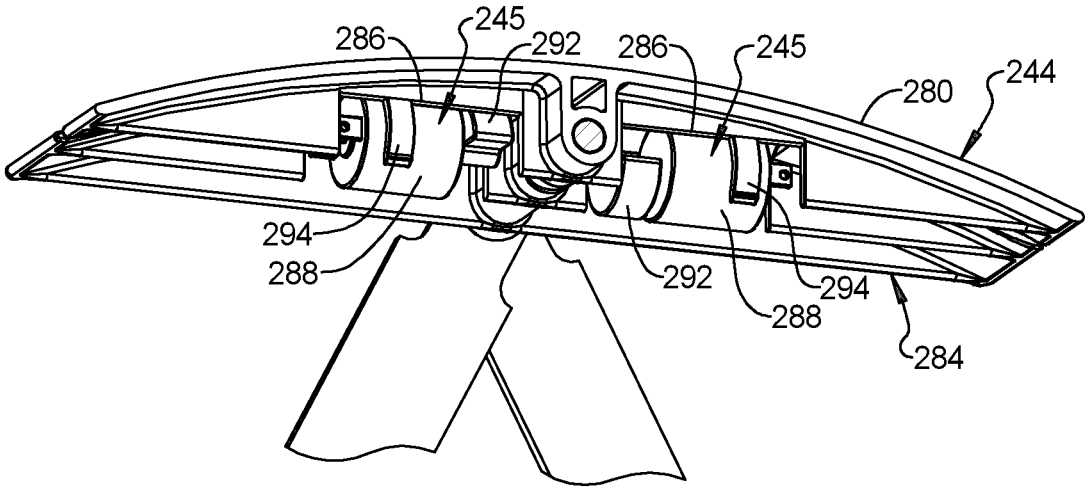
FIG. 26 is cross-sectional view of the lumbar pad of the lumbar adjustment assembly of FIG. 23.

Like the lumbar pad 44, 144, the lumbar pad 244 may be a relatively rigid member and may have a contoured support surface 280 (FIGS. 25 and 27). The support surface 280 may be in contact with and/or adjacent to the padding 281 and/or upholstery 283 that covers the seatback 14, 114 (as shown in FIG. 25). The lumbar adjustment assembly 216 may be positioned on the seatback frame 22, 122 such that the support surface 280 corresponds to the lumbar support section 20 of the seatback 14, 114 (i.e., the support surface 280 of the lumbar pad 244 supports the lumbar portion of a person's back who is sitting in the seating or furniture assembly 10, 110).

The massaging units 245 may be mounted to a backside 284 of the lumbar pad 244 (i.e., a side opposite the contoured surface 280). In the example shown in the figures, the backside 284 of the lumbar pad 244 may define one or more cavities 286 in which the massaging units 245 may be received.

Each of the massaging units 245 may include a motor 288, an output shaft 290, and an unbalanced weight 292. The motor 288 of each massaging unit 245 can be disposed within a respective one of the cavities 286 in the lumbar pad 244 and may be fixed relative to the lumbar pad 244 in any suitable manner. In the example shown in the figures, the motors 288 are retained within the respective cavities 286 by a plurality of resiliently flexible arms 294 (one or more arms 294 may retain each motor 288 within the respective cavity 286). The arms 294 may be living hinges that are integrally formed with the lumbar pad 244 and securely retain the massaging units 245 to the lumbar pad 244 and yet allow for relatively easy installation and removal of the massaging units 245. It will be appreciated that any suitable brackets, fasteners, and/or other mounting structures could be utilized instead of or in addition to the arms 294 to fix the motors 288 relative to the lumbar pad 244.

The outputs shafts 290 and unbalanced weights 292 are rotatable relative to the lumbar pad 244. Each output shaft 290 is connected to a respective one of the motors 288 and a respective one of the unbalanced weights 292. During operation of the massaging units 245, the motors 288 may spin the output shafts 290, thereby spinning the unbalanced weights 292 relative to the lumbar pad 244. Because the unbalanced weights 292 are rotationally unbalanced, spinning of the unbalanced weights 292 (by operation of the motors 288) causes the massaging units 245 to vibrate. Such vibrations propagate from the motors 288 to the lumbar pad 244. Such vibration of the lumbar pad 244 can be felt by an occupant of the furniture assembly 10, 110. That is, a person seated in the furniture assembly 10, 110 may feel vibrations in his/her back when he/she rests his/her back against the upholstery 282 of the seatback 14, 114. In some configurations, the vibrations from the massaging units 245 may propagate throughout the entire lumbar adjustment assembly 216 and into the seatback frame 22, 122 and potentially into the seat bottom 12, 112 and legrest assembly 18, 118 to provide a vibrating massaging effect that the occupant can feel throughout the furniture assembly 10, 110.

The amplitude and frequency of the vibrations created by the massaging units 245 can be adjusted by adjusting the rotational speed of the motors 288 and the amount of rotational unbalance of the unbalanced weights 292. In some configurations, a user interface (e.g., buttons or knobs on the furniture assembly 10, 110 or a remote control unit) may be provided to allow the occupant of the furniture assembly 10, 110 to actively control the rotational speed of the motors 288 to personalize and actively adjust the massaging effect of the massaging units 245 while the occupant is seated in the furniture assembly 10, 110.

In some configurations (as shown in FIG. 25), a damping pad 296 (e.g., a relatively thin sheet of foam, rubber or other soft, compressible material) may be disposed within each of the cavities 286 to insulate the motors 288 from the relatively hard material of the lumbar pad 244. The damping pads 296 may deaden some of the sound associated with the vibration of the massaging units 245 to prevent any excessive rattling or other undesirable noises that might otherwise be caused by direct contact between the massaging units 245 and the lumbar pad 244 and/or other hard structures/components. The damping pads 296 could be disposed between the motors 288 and the bottoms of the cavities 286 and/or between the motors 288 and the arms 294.

Furthermore, in some configurations, the lumbar pad 244 may include a removable lid 297 (shown in phantom lines in FIG. 25) that can be removably attached to the backside 284 of the lumbar pad 244 to enclose the massaging units 245 within the lumbar pad 244.

Figure 24:
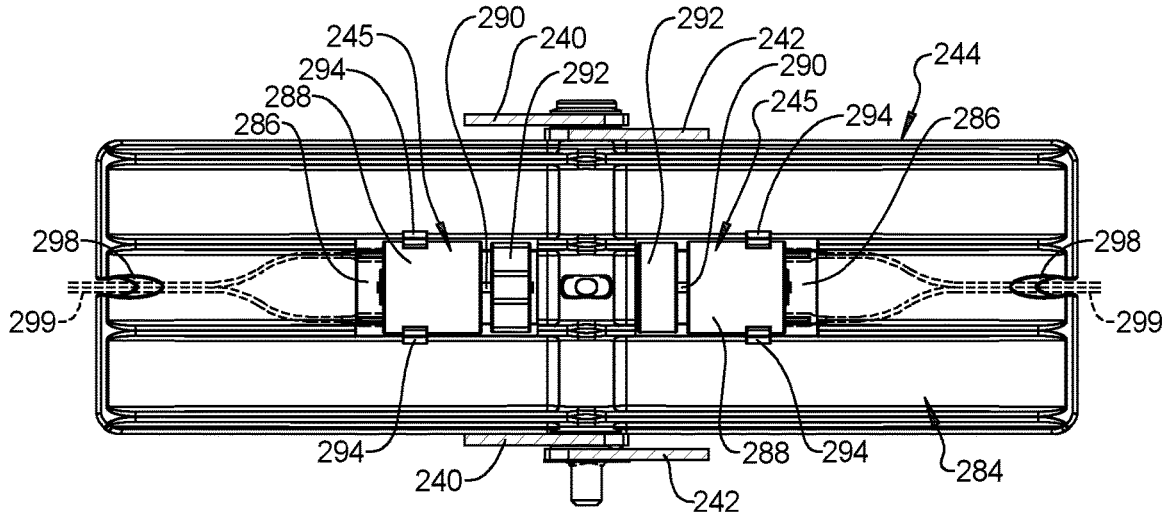
FIG. 24 is a view of a back side of a lumbar pad of the lumbar adjustment assembly of FIG. 23.

In some configurations, the lumbar pad 244 may include one or more wire-routing features 298 (shown in FIGS. 23 and 24). The wire-routing features 298 may be apertures formed in the lumbar pad 244 (e.g., at or near edges of the lumbar pad 244 away from the links 240, 242 and slider blocks 236, 238). Wires 299 (shown in phantom lines in FIG. 24) connected to the motors 288 of the massaging units 245 may be routed through the wire-routing features 298 to ensure that the wires 299 do not get pulled by or tangled up in the moving parts of the lumbar adjustment assembly 216.

In some configurations, the massaging units could include air bladders mounted to the lumbar pad 244 (e.g., to the contoured surface 280 of the lumbar pad) that can be selectively inflated and deflated to create a massaging effect for a person seated in the furniture assembly 10, 110. These air bladders could be provided in addition to or instead of the motors 288, output shaft 290, and unbalanced weights 292 described above.

While the lumbar adjustment assembly 216 is shown in the figures as having only the first and second slider blocks 236, 238 and the first and second links 240, 242, it will be appreciated that the assembly 216 could include a third slider block and third links (similar or identical to the assembly 116).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture assembly comprising:

a seat bottom;

a seatback disposed adjacent the seat bottom and including a seatback frame;

a lumbar adjustment assembly mounted to the seatback frame and including a rail, a threaded rod disposed within the rail, a first slider block slidably engaging the rail, a second slider block slidably engaging the rail, a lumbar pad, and a plurality of links connecting the lumbar pad to the first and second slider blocks, wherein the threaded rod includes a first threaded section having threads with a first handedness and a second threaded section having threads with a second handedness that is opposite the first handedness, and wherein the first slider block threadably engages the first threaded section and the second slider block threadably engages the second threaded section; and a massaging unit mounted to the lumbar pad.

2. The furniture assembly of claim 1, wherein the massaging unit is mounted within a cavity formed in the lumbar pad.

3. The furniture assembly of claim 1, wherein the lumbar pad includes a resiliently flexible arm that secures the massaging unit to the lumbar pad.

4. The furniture assembly of claim 1, further comprising a damping pad in contact with the lumbar pad and the massaging unit.

5. The furniture assembly of claim 1, wherein the lumbar pad includes a wire-routing aperture through which a wire connected to the massaging unit extends.

6. The furniture assembly of claim 1, wherein the massaging unit includes a motor, an output shaft, and a rotationally unbalanced weight, wherein the output shaft is connected to the rotationally unbalanced weight, and wherein the motor spins the output shaft and the rotationally unbalanced weight relative to the lumbar pad.

7. The furniture assembly of claim 1, further comprising a motor assembly attached to the rail and rotatably driving the threaded rod relative to the rail, wherein the links include a pair of first links and a pair of second links, wherein a first end of each of the first links is rotatably coupled to the first slider block, wherein a second end of each of the first links is rotatably coupled to the lumbar pad, wherein a first end of each of the second links is rotatably coupled to the second slider block, and wherein a second end of each of the second links is rotatably coupled to the lumbar pad.

8. The furniture assembly of claim 1, wherein the lumbar pad moves in a direction perpendicular to a direction in which the first and second slider blocks move along the rail, wherein the lumbar pad moves away from the rail when the first and second slider blocks move toward each other along the rail, and wherein the lumbar pad moves toward from the rail when the first and second slider blocks move away from each other along the rail.

9. The furniture assembly of claim 1, wherein each of the first and second slider blocks includes a channel that slidably and non-rotatably receives the rail.

10. The furniture assembly of claim 1, wherein the threaded rod is a single, unitary body.

11. The furniture assembly of claim 1, further comprising:

a third slider block slidably engaging the rail and threadably engaging the second threaded section; and additional links connecting the lumbar pad to the third slider block.

12. An adjustment assembly for a furniture assembly, the adjustment assembly comprising:

a motor assembly;

a rail attached to the motor assembly;

a threaded rod coupled to the motor assembly and disposed within a channel of the rail, the threaded rod including a first threaded section having threads with a first handedness and a second threaded section having threads with a second handedness that is opposite the first handedness;

a first slider block slidably engaging the rail and threadably engaging the first threaded section;

a second slider block slidably engaging the rail and threadably engaging the second threaded section;

a plurality of links rotatably coupled to the first and second slider blocks;

a support member attached to the plurality of links; and a massaging unit mounted to the support member.

13. The adjustment assembly of claim 12, wherein the massaging unit is mounted within a cavity formed in the support member.

14. The adjustment assembly of claim 12, wherein the support member includes a resiliently flexible arm that secures the massaging unit to the support member.

15. The adjustment assembly of claim 12, further comprising a damping pad in contact with the support member and the massaging unit.

16. The adjustment assembly of claim 12, wherein the support member includes a wire-routing aperture through which a wire connected to the massaging unit extends.

17. The adjustment assembly of claim 12, wherein the massaging unit includes a motor, an output shaft, and a rotationally unbalanced weight, wherein the output shaft is connected to the rotationally unbalanced weight, and wherein the motor spins the output shaft and the rotationally unbalanced weight relative to the support member.

18. The adjustment assembly of claim 12, further comprising a motor assembly attached to the rail and rotatably driving the threaded rod relative to the rail, wherein the links include a pair of first links and a pair of second links, wherein a first end of each of the first links is rotatably coupled to the first slider block, wherein a second end of each of the first links is rotatably coupled to the support member, wherein a first end of each of the second links is rotatably coupled to the second slider block, and wherein a second end of each of the second links is rotatably coupled to the support member.

19. The adjustment assembly of claim 12, wherein the support member moves in a direction perpendicular to a direction in which the first and second slider blocks move along the rail, wherein the support member moves away from the rail when the first and second slider blocks move toward each other along the rail, and wherein the support member moves toward from the rail when the first and second slider blocks move away from each other along the rail.

20. The adjustment assembly of claim 12, wherein each of the first and second slider blocks includes a channel that slidably and non-rotatably receives the rail.

21. The adjustment assembly of claim 12, wherein the threaded rod is a single, unitary body.

22. The adjustment assembly of claim 12, further comprising:

a third slider block slidably engaging the rail and threadably engaging the second threaded section; and additional links connecting the support member to the third slider block.

23. The adjustment assembly of claim 12, wherein the support member is a lumbar pad, and wherein the rail is connected to a seatback frame.

24. A furniture assembly comprising:

a seat bottom;

a seatback disposed adjacent the seat bottom and including a seatback frame;

a lumbar adjustment assembly mounted to the seatback frame and including a lumbar pad, a plurality of links connecting the lumbar pad, and a motor assembly configured to drive the links to move the lumbar pad relative to the seatback frame between a first position and a second position, wherein the lumbar pad is configured to push an upholstery of the seatback as the lumbar pad moves between the first and second positions; and a massaging unit mounted to the lumbar pad and configured to move with the lumbar pad relative to the seatback frame between the first position and the second position.

25. The furniture assembly of claim 24, wherein the massaging unit is configured to transmit vibration through the lumbar pad.

26. The furniture assembly of claim 25, wherein the massaging unit is mounted within a cavity formed in the lumbar pad.

27. The furniture assembly of claim 26, further comprising a damping pad in contact with the lumbar pad and the massaging unit.

28. The furniture assembly of claim 27, wherein the massaging unit includes a motor, an output shaft, and a rotationally unbalanced weight, wherein the output shaft is connected to the rotationally unbalanced weight, and wherein the motor spins the output shaft and the rotationally unbalanced weight relative to the lumbar pad.

29. The furniture assembly of claim 28, wherein the lumbar pad includes a wire-routing aperture through which a wire connected to the massaging unit extends.

30. The furniture assembly of claim 29, wherein the lumbar pad includes a resiliently flexible arm that secures the massaging unit to the lumbar pad.

* * * * *